US006795074B1

(12) United States Patent
McBride et al.

(10) Patent No.: US 6,795,074 B1
(45) Date of Patent: Sep. 21, 2004

(54) DISPLAYING CHARACTERS ON A DOT-MATRIX DISPLAY

(75) Inventors: Aaron A. McBride, Salt Lake City, UT (US); Michelle R. Metcalf, Pleasant Grove, UT (US)

(73) Assignee: Intel Corporation, Santa Clara, CA (US)

( * ) Notice: Subject to any disclaimer, the term of this patent is extended or adjusted under 35 U.S.C. 154(b) by 480 days.

(21) Appl. No.: 09/718,439

(22) Filed: Nov. 22, 2000

(51) Int. Cl.[7] ..... G09G 5/24
(52) U.S. Cl. ..... 345/467
(58) Field of Search ..... 345/467

(56) References Cited

U.S. PATENT DOCUMENTS 4,300,206 A * 11/1981 Belleson et al. ..... 358/1.18
4,426,645 A * 1/1984 Sakai et al. ..... 345/467
4,741,045 A * 4/1988 Denning ..... 382/178
5,016,000 A * 5/1991 Bugg ..... 345/472.2
5,404,432 A * 4/1995 Koopman et al. ..... 715/528
5,404,436 A * 4/1995 Hamilton ..... 345/472
6,377,262 B1 * 4/2002 Hitchcock et al. ..... 345/467
6,421,054 B1 * 7/2002 Hill et al. ..... 345/469

OTHER PUBLICATIONS

Kinghorn, U.S. patent # 4,323,892—The use of descender letters and/or characters on a display device.*
"ASCII," website: www.zdwebopedia.com.
"ASCII—ISO 8859–1 (Latin–1) Table with HTML Entity Names," www.bbsinc.com.
"1.11 The ASCII Character Set," website: http://webster.cs.ucr.edu.
"ANSI Character Set," website: www.zdwebopedia.com.
"character based," website: www.zdwebopedia.com.

* cited by examiner

*Primary Examiner*—Jeffery Brier
(74) *Attorney, Agent, or Firm*—John F. Kacvinsky

(57) ABSTRACT

Displaying characters on a dot-matrix display includes characters for display on a display device and an array of pixel boxes for displaying the characters, where each of the characters is justified against one side of the pixel box included in the array of pixel boxes and occupies a standard width of four pixels in the pixel box.

21 Claims, 26 Drawing Sheets

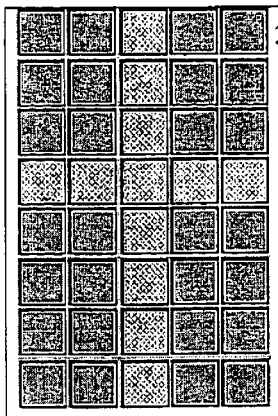
0x11 FIG. 2
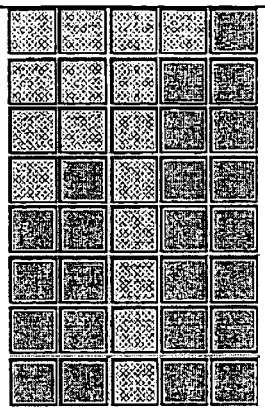
0x12 FIG. 3
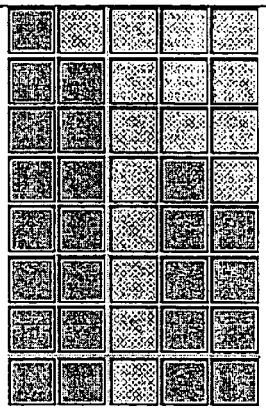
0x13 FIG. 4
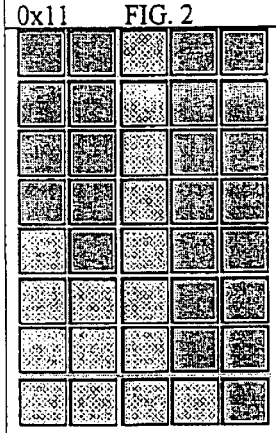
0x14 FIG. 5
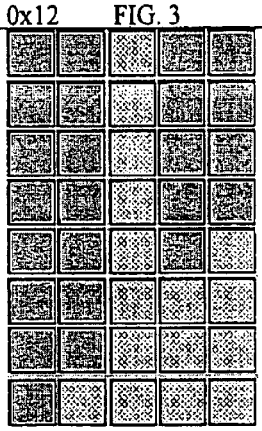
0x15 FIG. 6
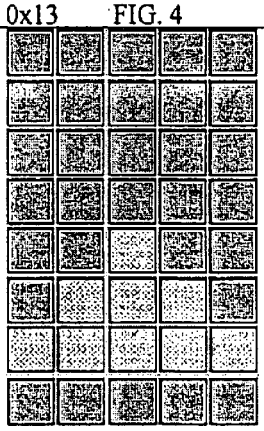
0x16 FIG. 7
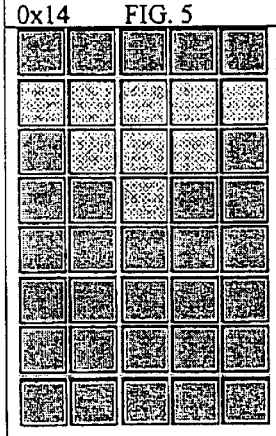
0x17 FIG. 8
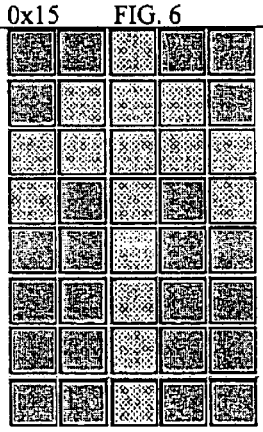
0x18 FIG. 9
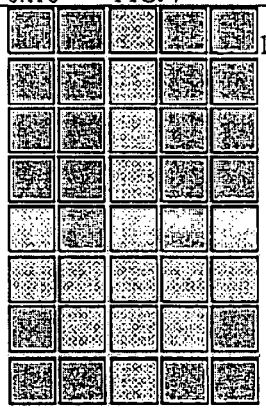
0x19 FIG. 10

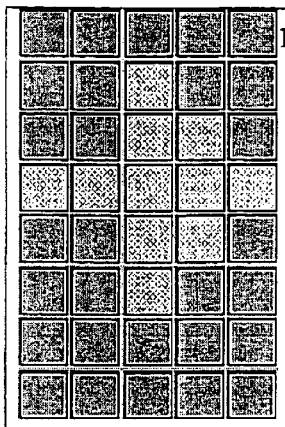
0x1A FIG. 11
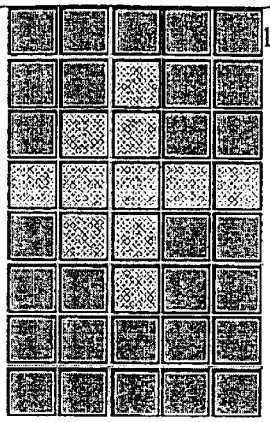
0x1B FIG. 12
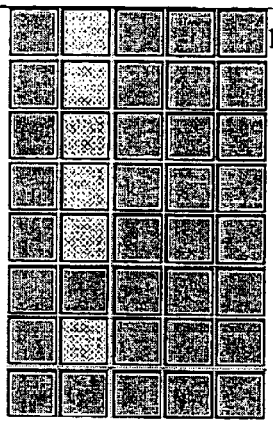
0x21 FIG. 13
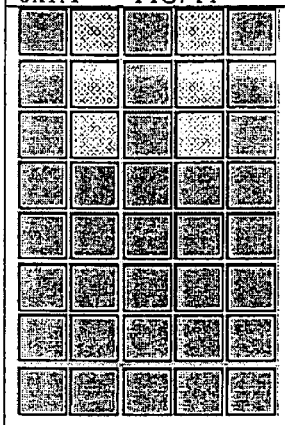
0x22 FIG. 14
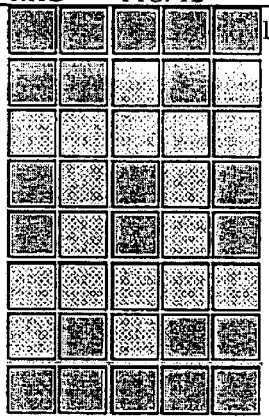
0x23 FIG. 15
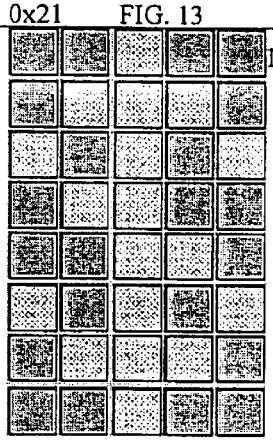
0x24 FIG. 16
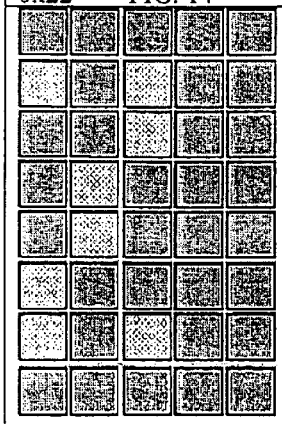
0x25 FIG. 17
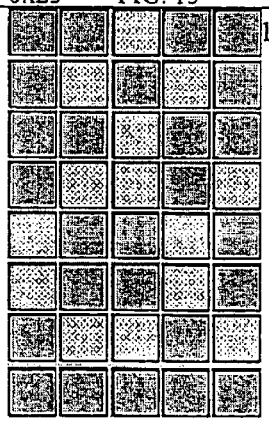
0x26 FIG. 18
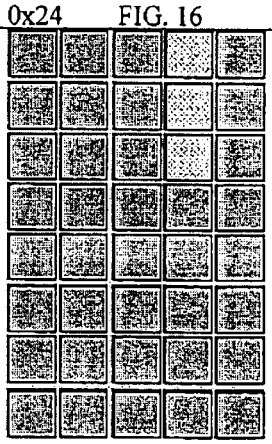
0x27 FIG. 19

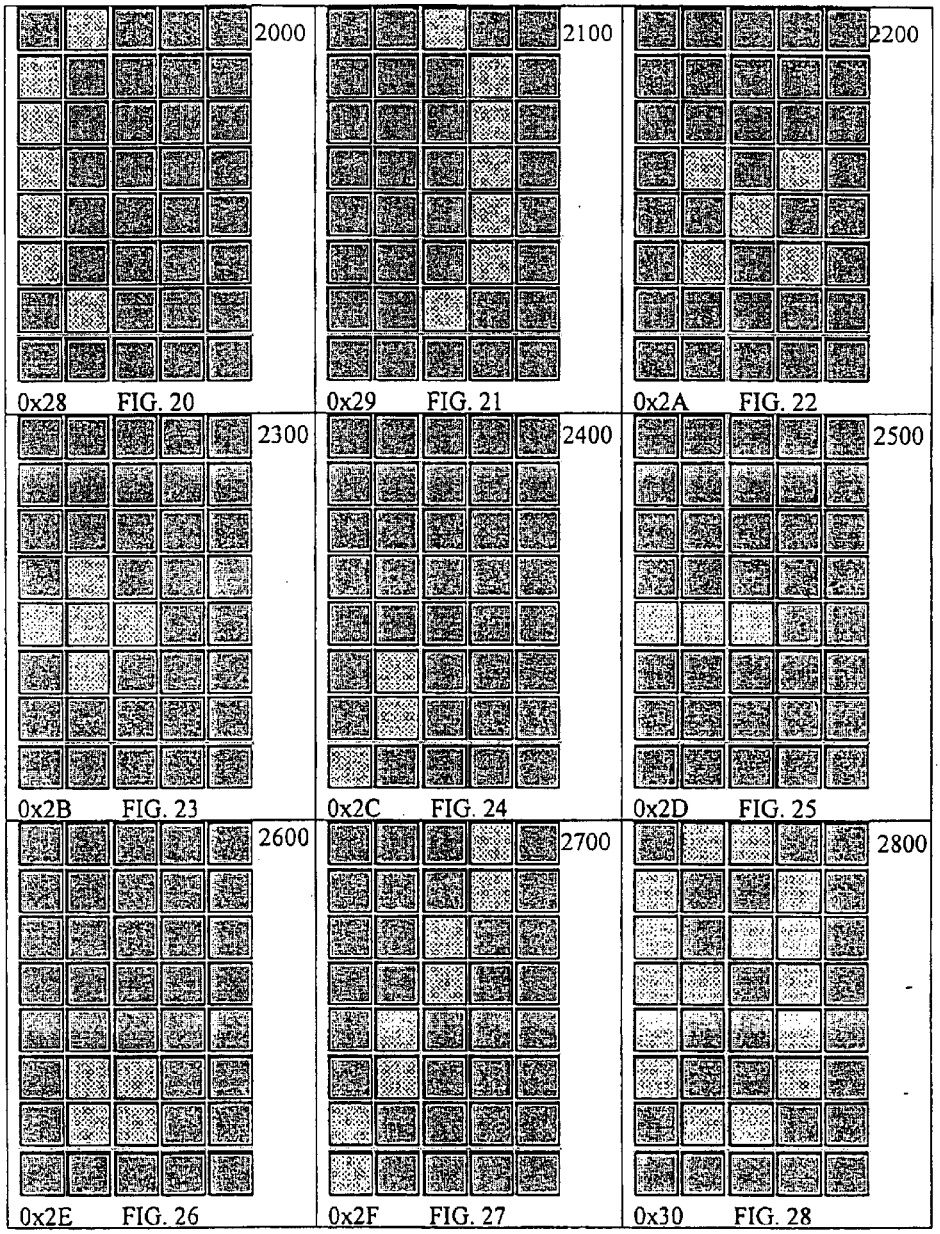
2000
0x28 FIG. 20
2100
0x29 FIG. 21
2200
0x2A FIG. 22
2300
0x2B FIG. 23
2400
0x2C FIG. 24
2500
0x2D FIG. 25
2600
0x2E FIG. 26
2700
0x2F FIG. 27
2800
0x30 FIG. 28

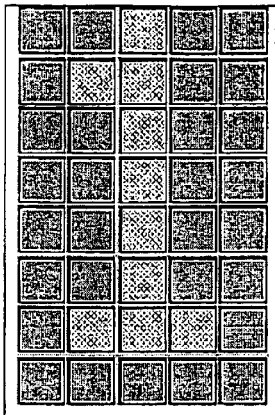
0x31 FIG. 29
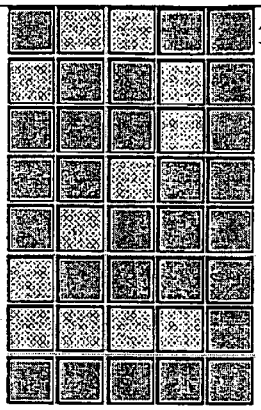
0x32 FIG. 30
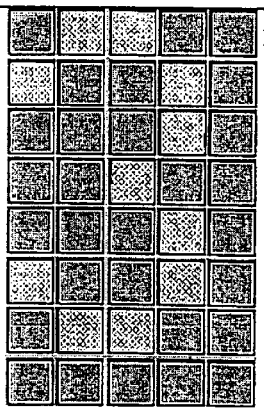
0x33 FIG. 31
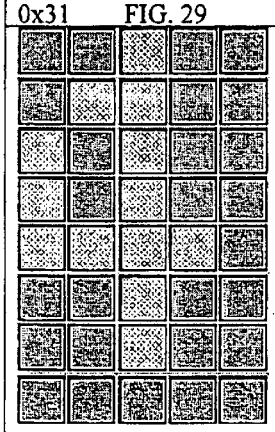
0x34 FIG. 32
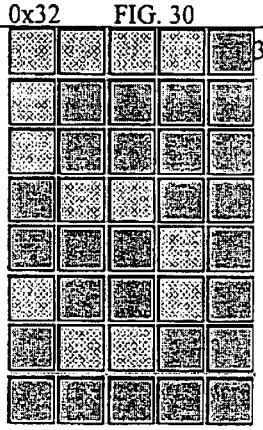
0x35 FIG. 33
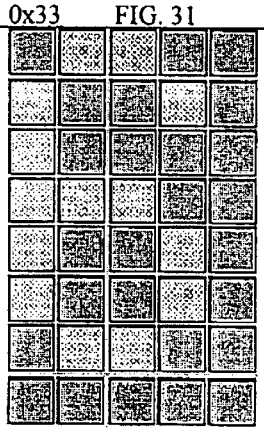
0x36 FIG. 34
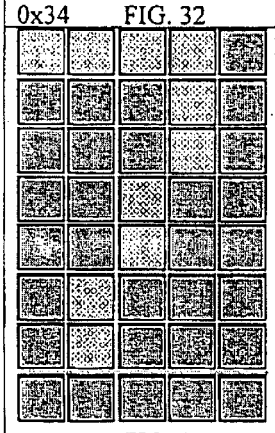
0x37 FIG. 35
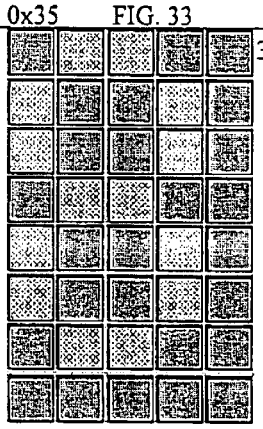
0x38 FIG. 36
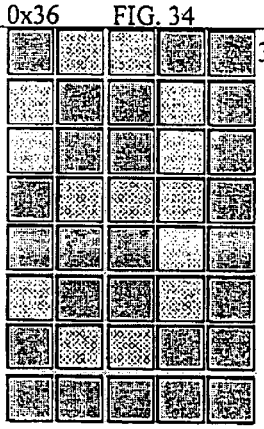
0x39 FIG. 37

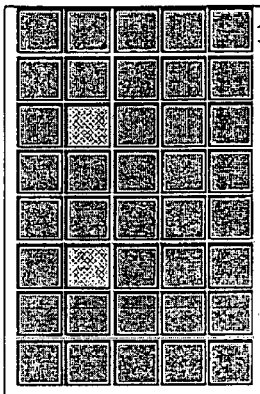
0x3A FIG. 38
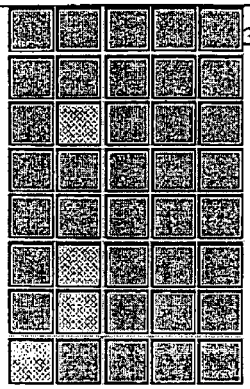
0x3B FIG. 39
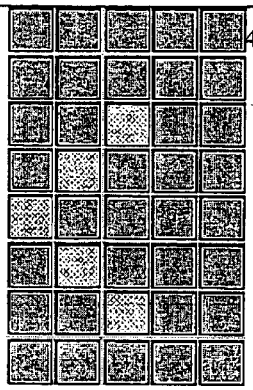
0x3C FIG. 40
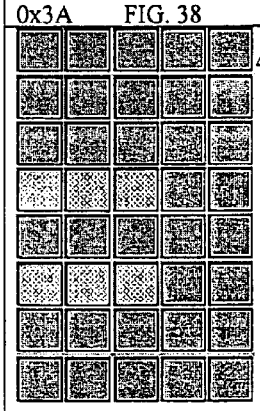
0x3D FIG. 41
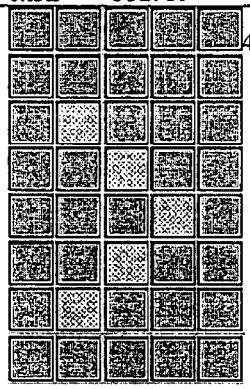
0x3E FIG. 42
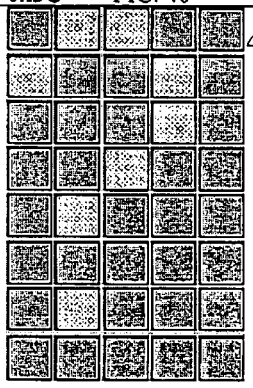
0x3F FIG. 43
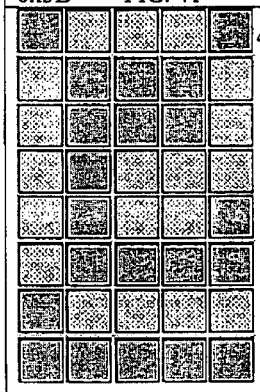
0x40 FIG. 44
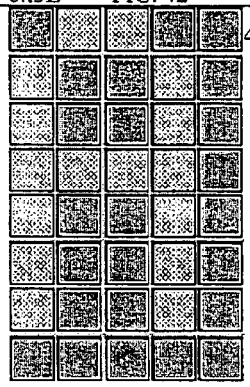
0x41 FIG. 45
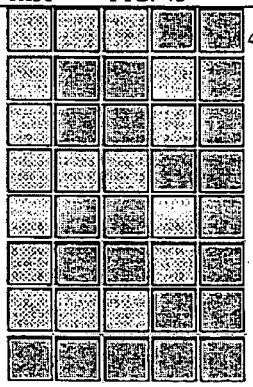
0x42 FIG. 46

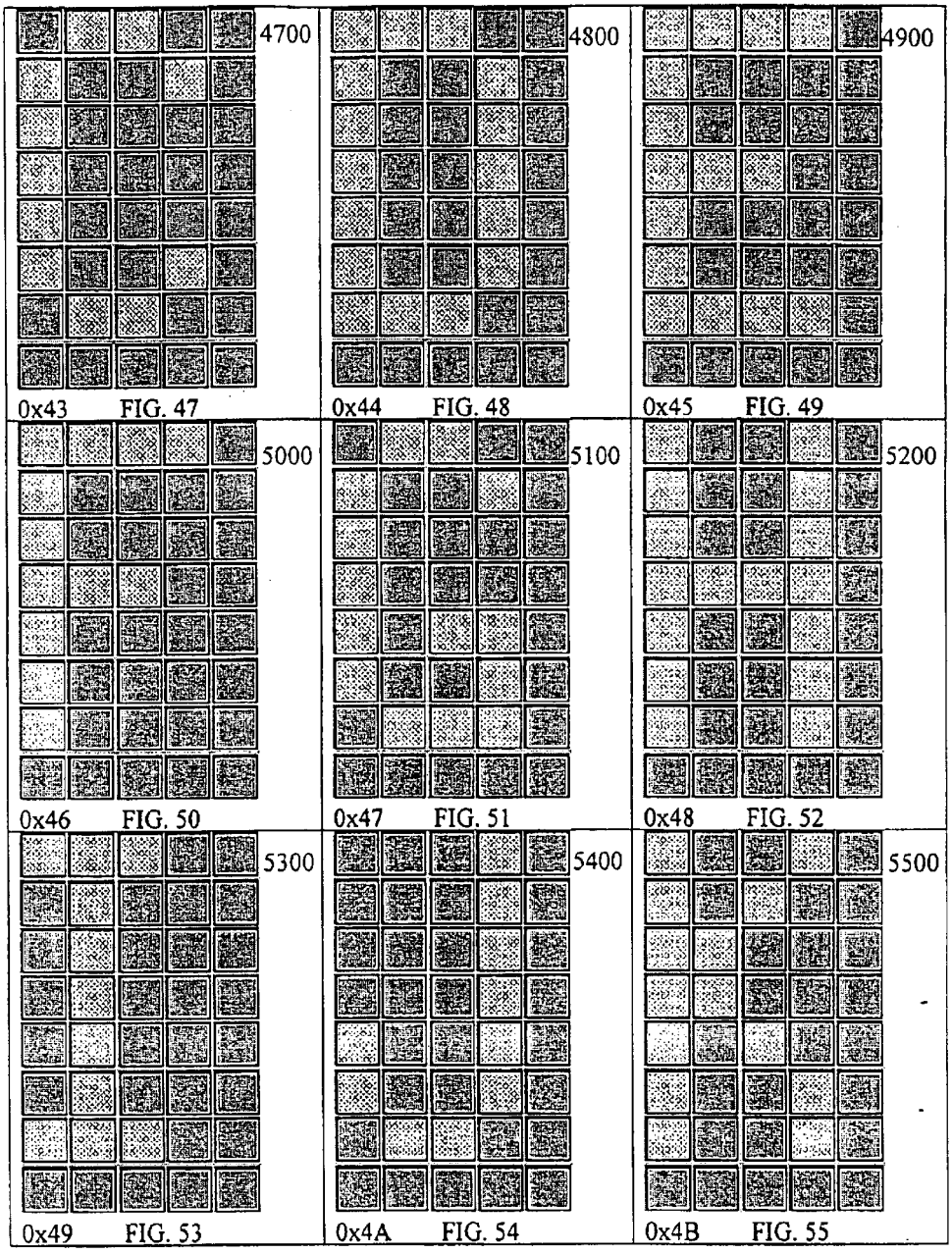
4700
4800
4900
0x43 FIG. 47
0x44 FIG. 48
0x45 FIG. 49
5000
5100
5200
0x46 FIG. 50
0x47 FIG. 51
0x48 FIG. 52
5300
5400
5500
0x49 FIG. 53
0x4A FIG. 54
0x4B FIG. 55

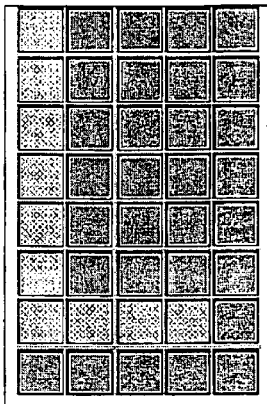
0x4C FIG. 56
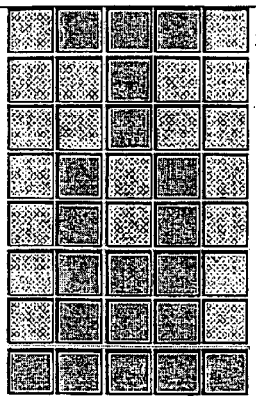
0x4D FIG. 57
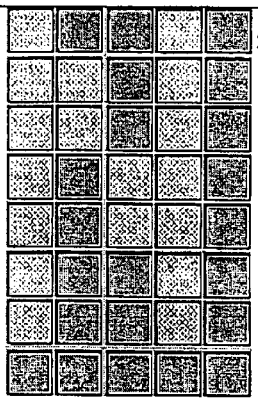
0x4E FIG. 58
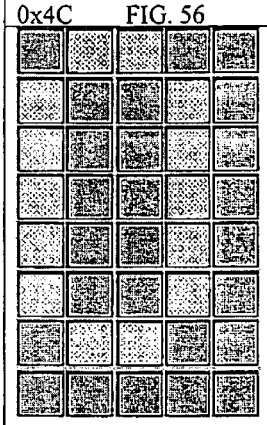
0x4F FIG. 59
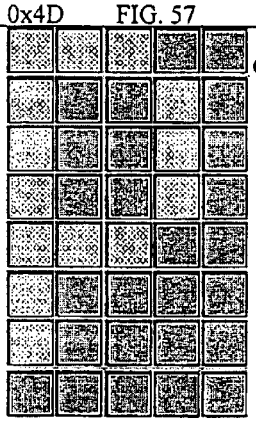
0x50 FIG. 60
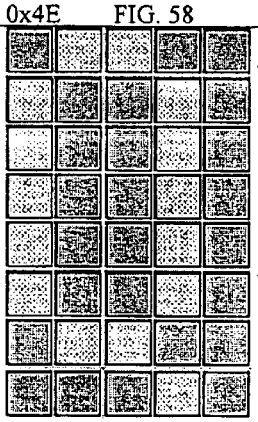
0x51 FIG. 61
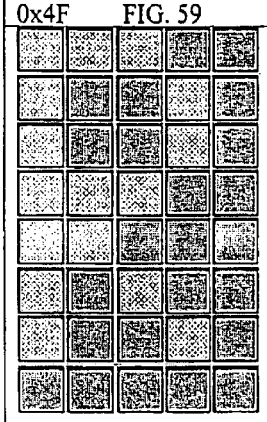
0x52 FIG. 62
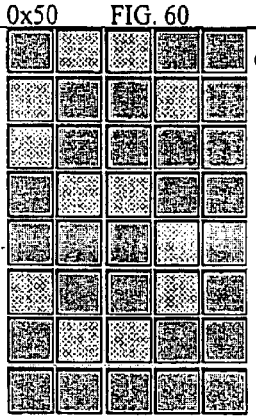
0x53 FIG. 63
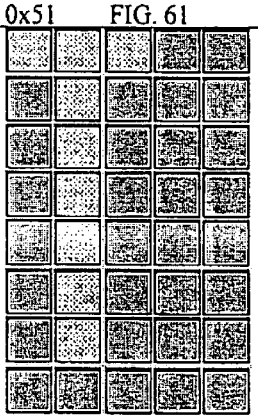
0x54 FIG. 64

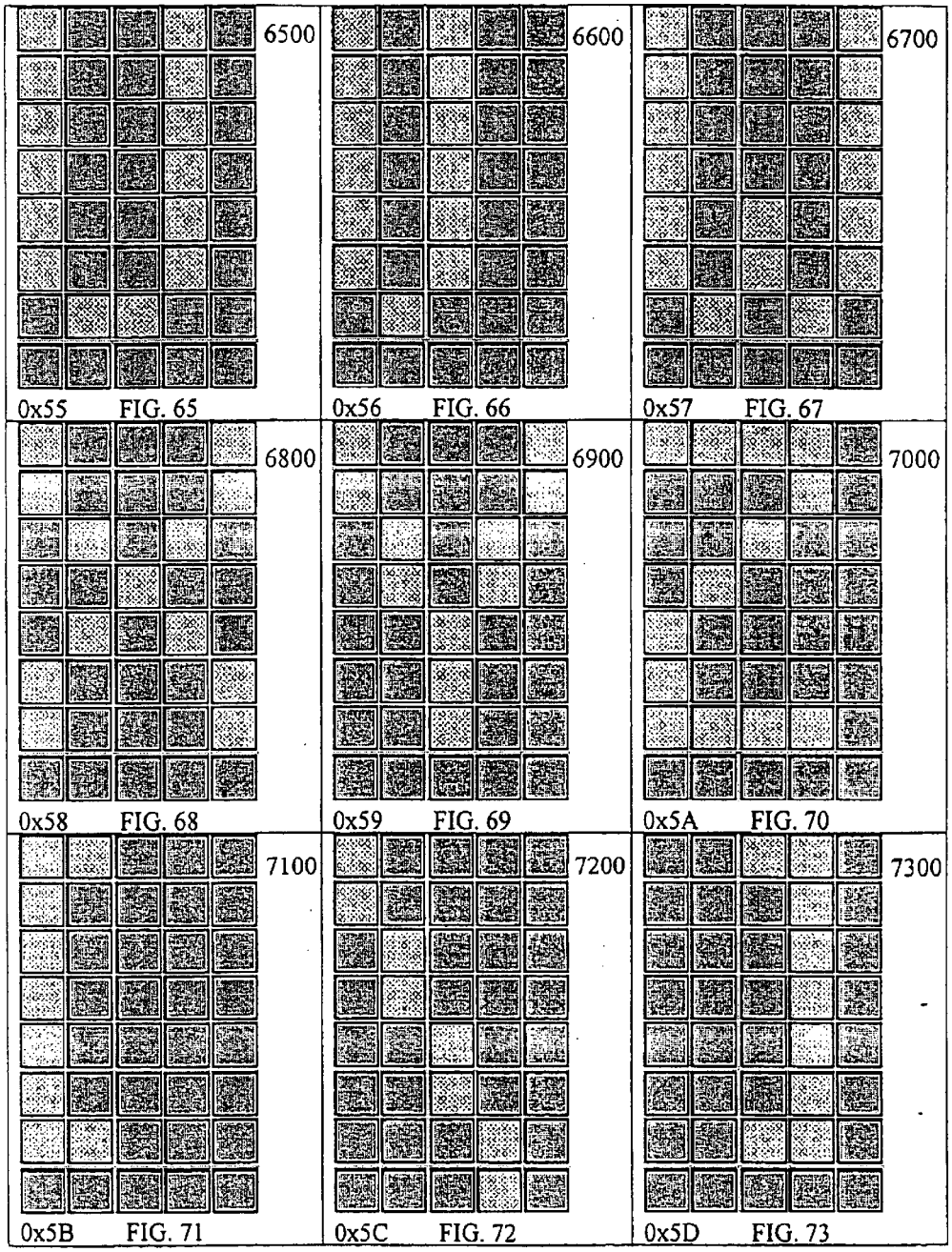
6500
0x55 FIG. 65
6600
0x56 FIG. 66
6700
0x57 FIG. 67
6800
0x58 FIG. 68
6900
0x59 FIG. 69
7000
0x5A FIG. 70
7100
0x5B FIG. 71
7200
0x5C FIG. 72
7300
0x5D FIG. 73

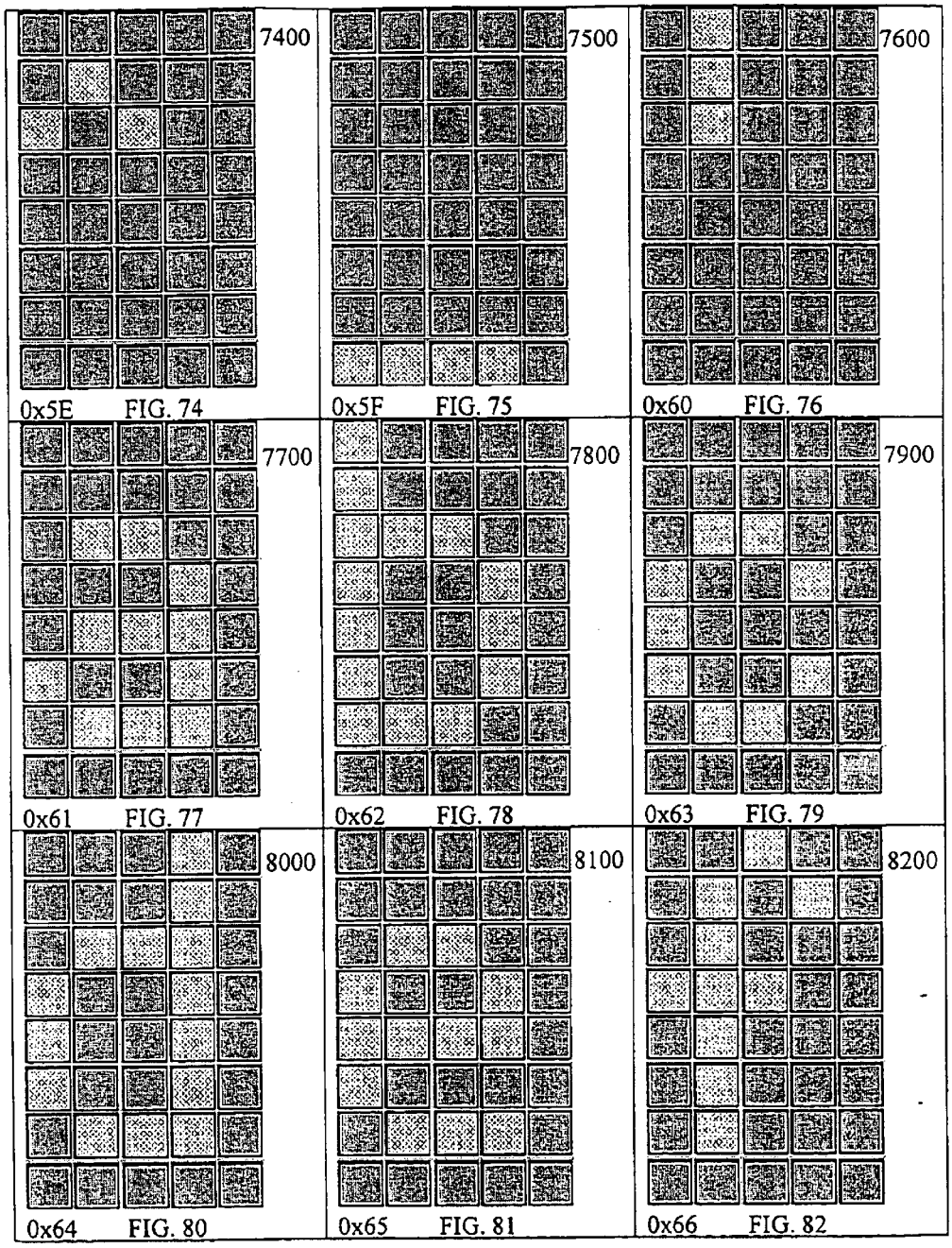
7400
0x5E FIG. 74
7500
0x5F FIG. 75
7600
0x60 FIG. 76
7700
0x61 FIG. 77
7800
0x62 FIG. 78
7900
0x63 FIG. 79
8000
0x64 FIG. 80
8100
0x65 FIG. 81
8200
0x66 FIG. 82

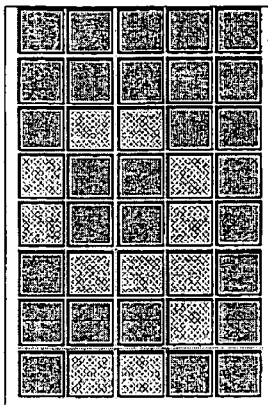
0x67 FIG. 83
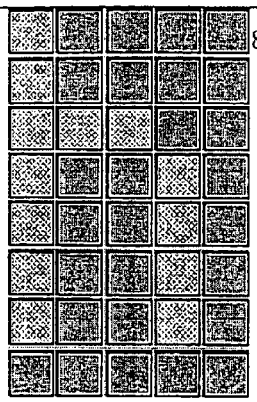
0x68 FIG. 84
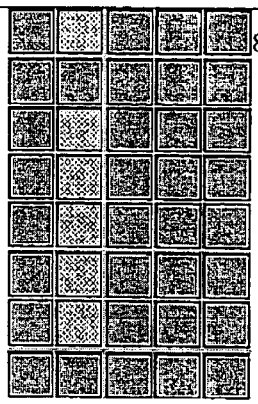
0x69 FIG. 85
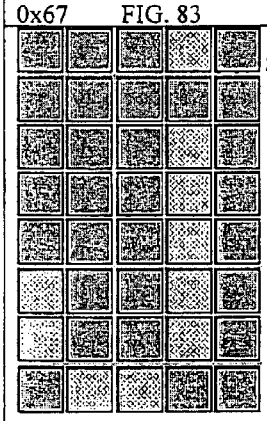
0x6A FIG. 86
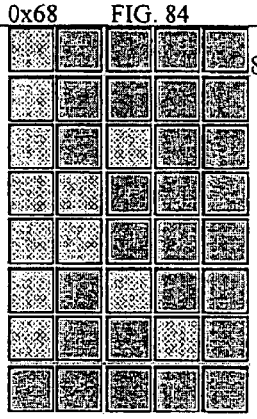
0x6B FIG. 87
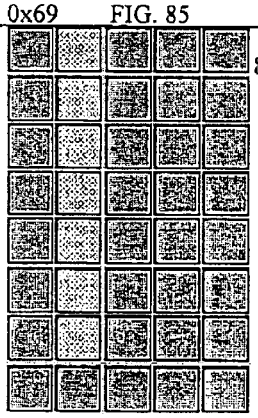
0x6C FIG. 88
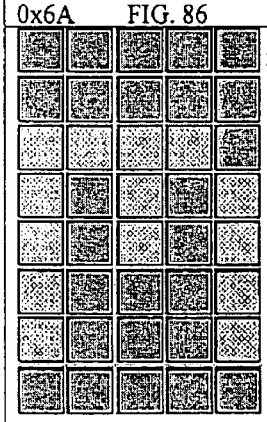
0x6D FIG. 89
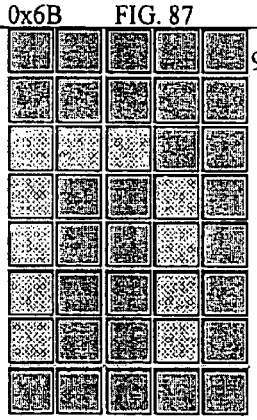
0x6E FIG. 90
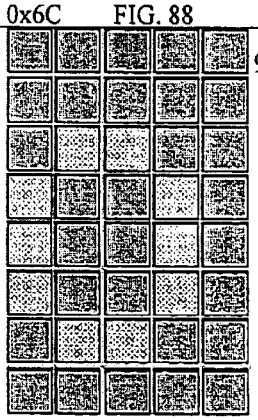
0x6F FIG. 91

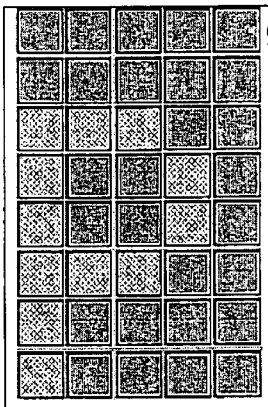
0x70 FIG. 92
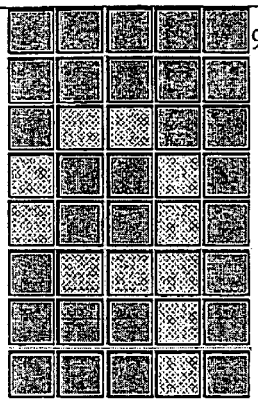
0x71 FIG. 93
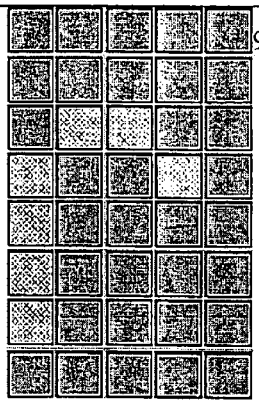
0x72 FIG. 94
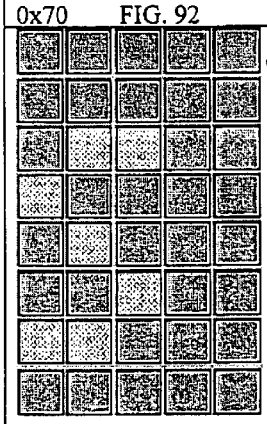
0x73 FIG. 95
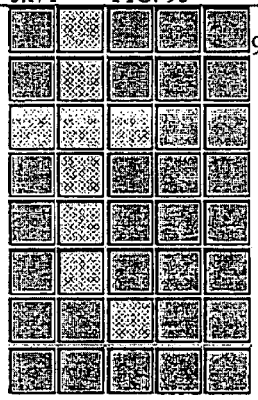
0x74 FIG. 96
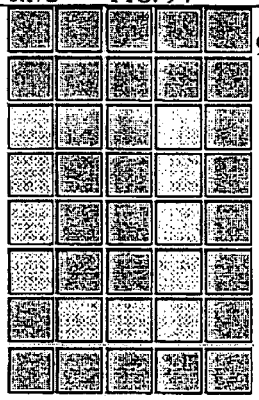
0x75 FIG. 97
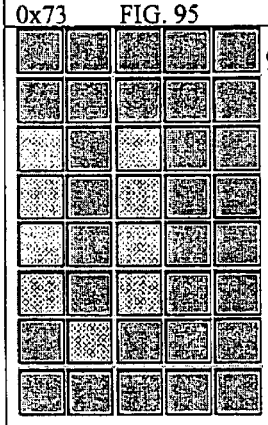
0x76 FIG. 98
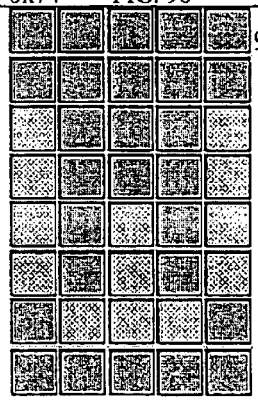
0x77 FIG. 99
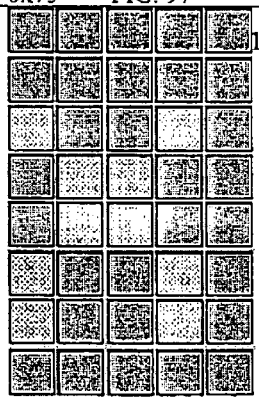
0x78 FIG. 100

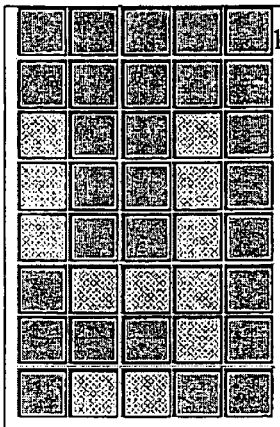
0x79 FIG. 101
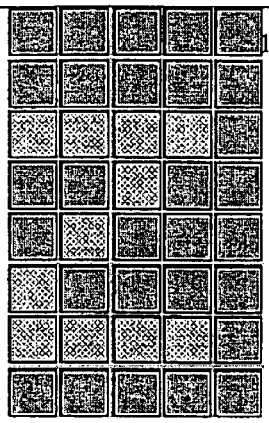
0x7A FIG. 102
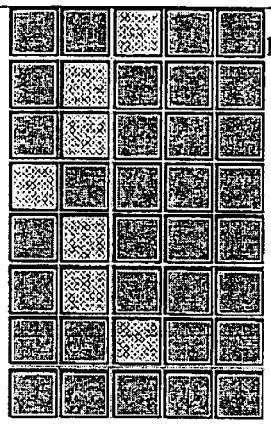
0x7B FIG. 103
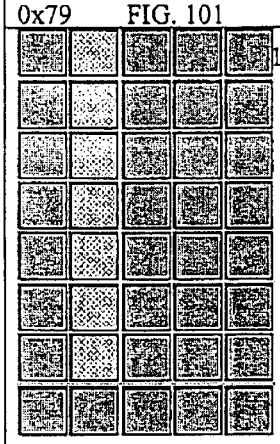
0x7C FIG. 104
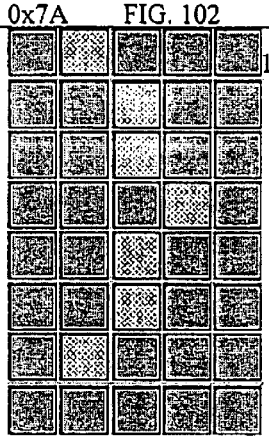
0x7D FIG. 105
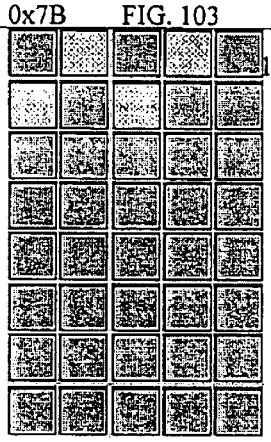
0x7E FIG. 106
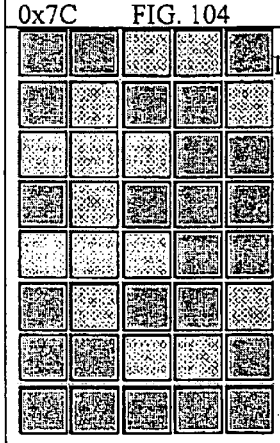
0x80 FIG. 107
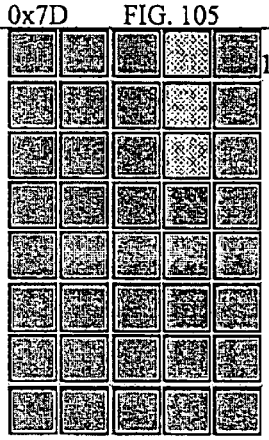
0x91 FIG. 108
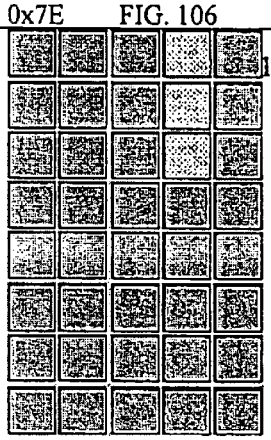
0x92 FIG. 109

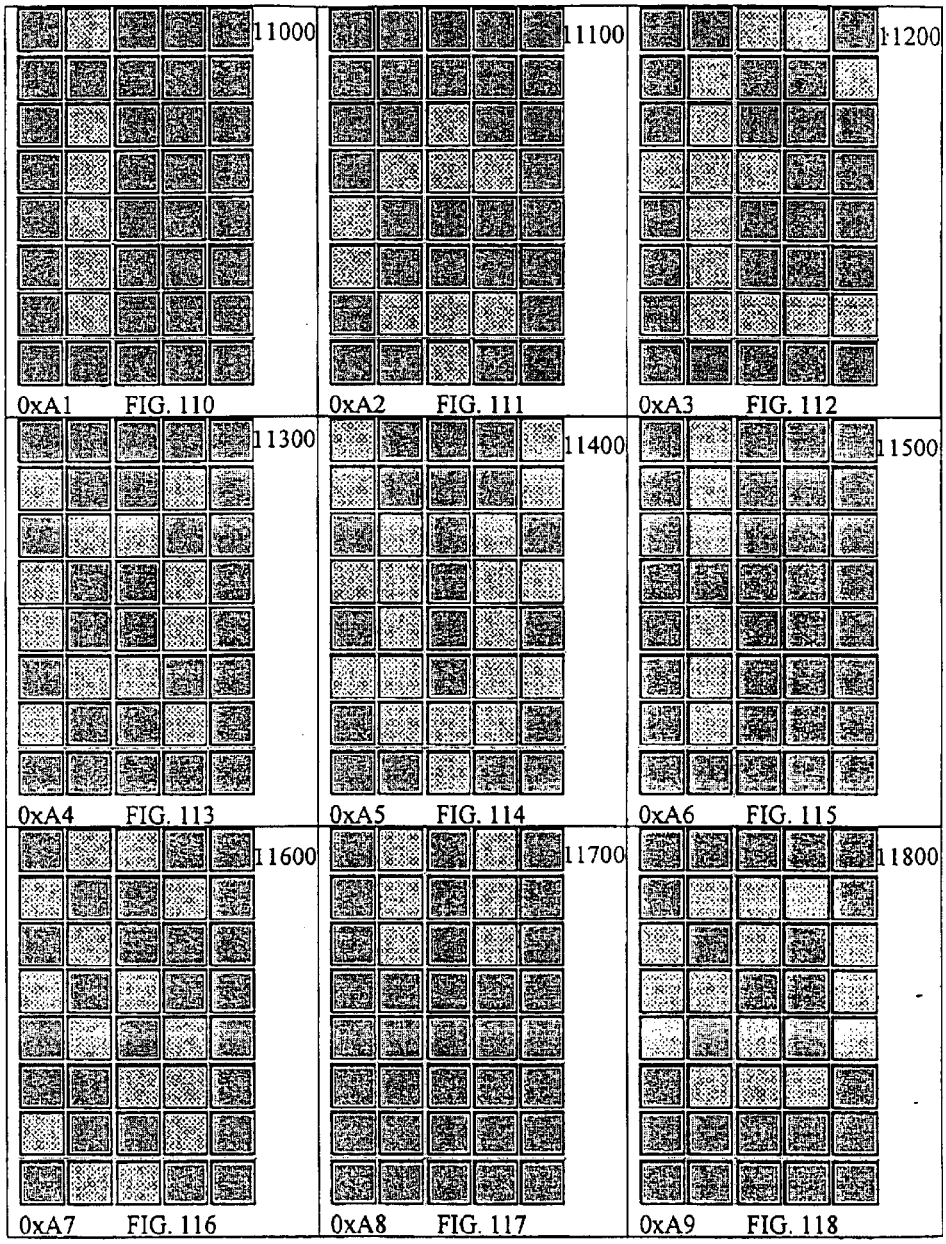
11000
0xA1 FIG. 110
11100
0xA2 FIG. 111
11200
0xA3 FIG. 112
11300
0xA4 FIG. 113
11400
0xA5 FIG. 114
11500
0xA6 FIG. 115
11600
0xA7 FIG. 116
11700
0xA8 FIG. 117
11800
0xA9 FIG. 118

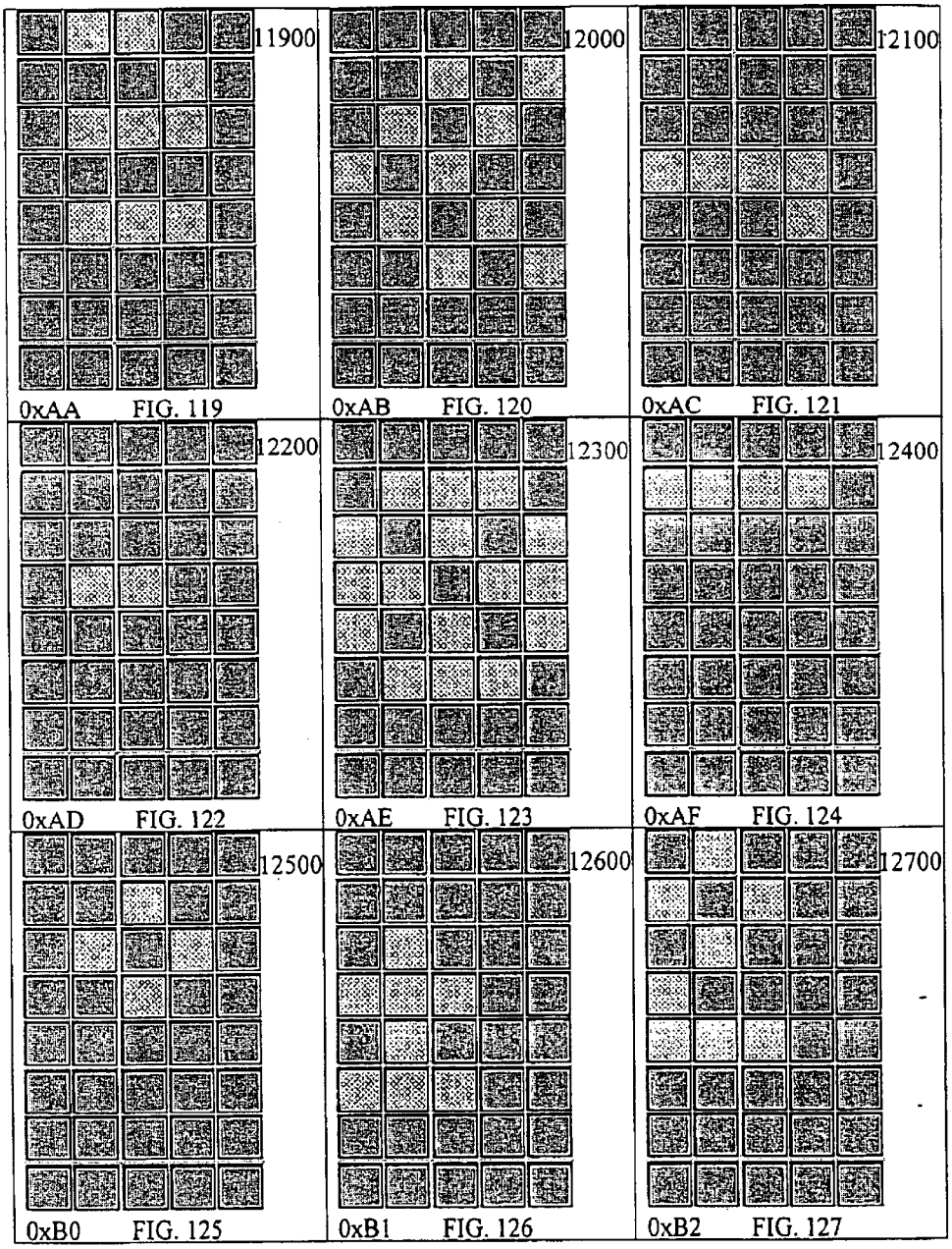
11900
0xAA FIG. 119
12000
0xAB FIG. 120
12100
0xAC FIG. 121
12200
0xAD FIG. 122
12300
0xAE FIG. 123
12400
0xAF FIG. 124
12500
0xB0 FIG. 125
12600
0xB1 FIG. 126
12700
0xB2 FIG. 127

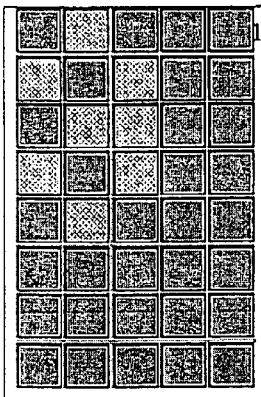
0xB3 FIG. 128
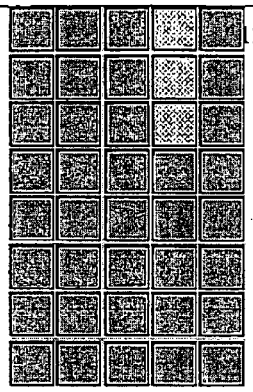
0xB4 FIG. 129
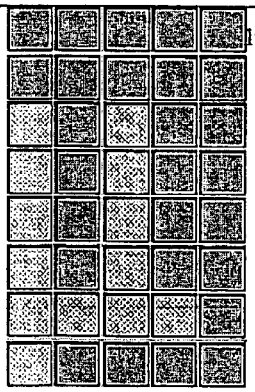
0xB5 FIG. 130
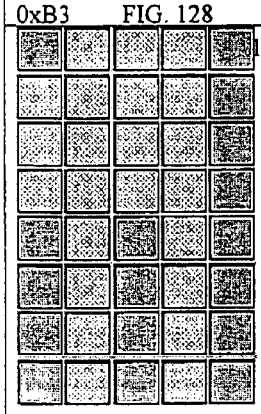
0xB6 FIG. 131
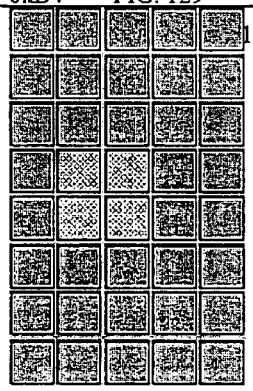
0xB7 FIG. 132
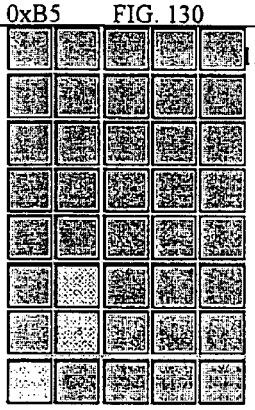
0xB8 FIG. 133
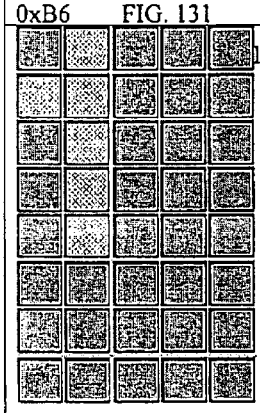
0xB9 FIG. 134
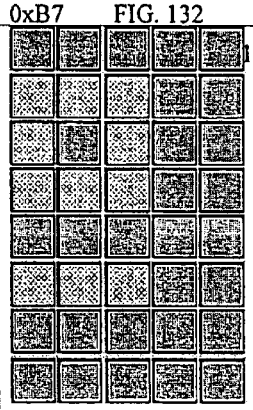
0xBA FIG. 135
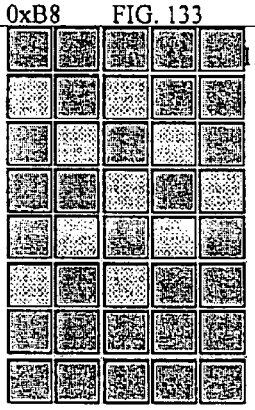
0xBB FIG. 136

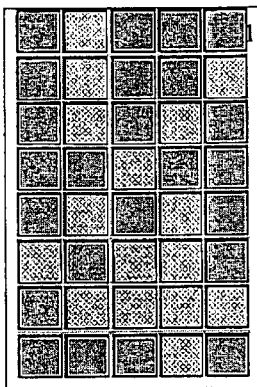
0xBC FIG. 137
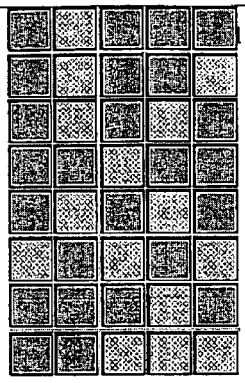
0xBD FIG. 138
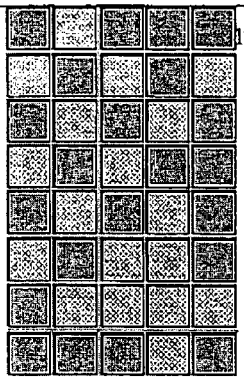
0Xbe FIG. 139
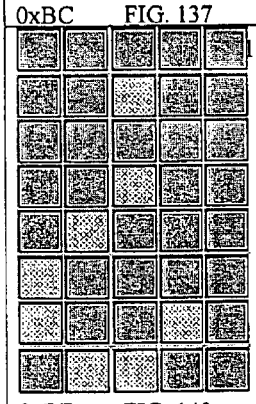
0xBF FIG. 140
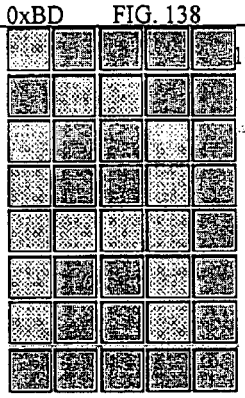
0xC0 FIG. 141
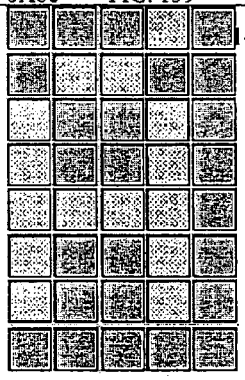
0xC1 FIG. 142
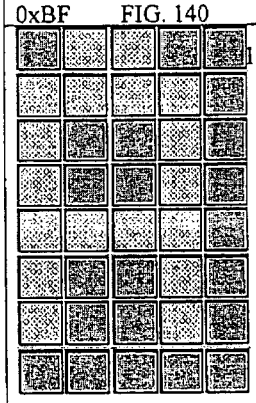
0xC2 FIG. 143
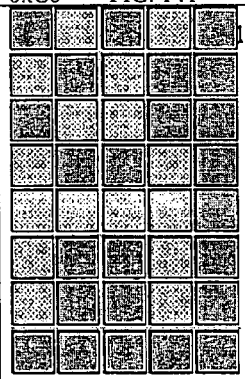
0xC3 FIG. 144
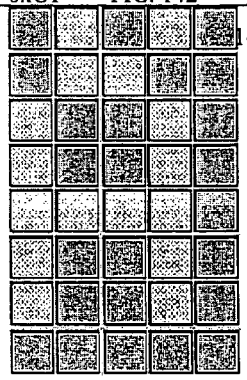
0xC4 FIG. 145

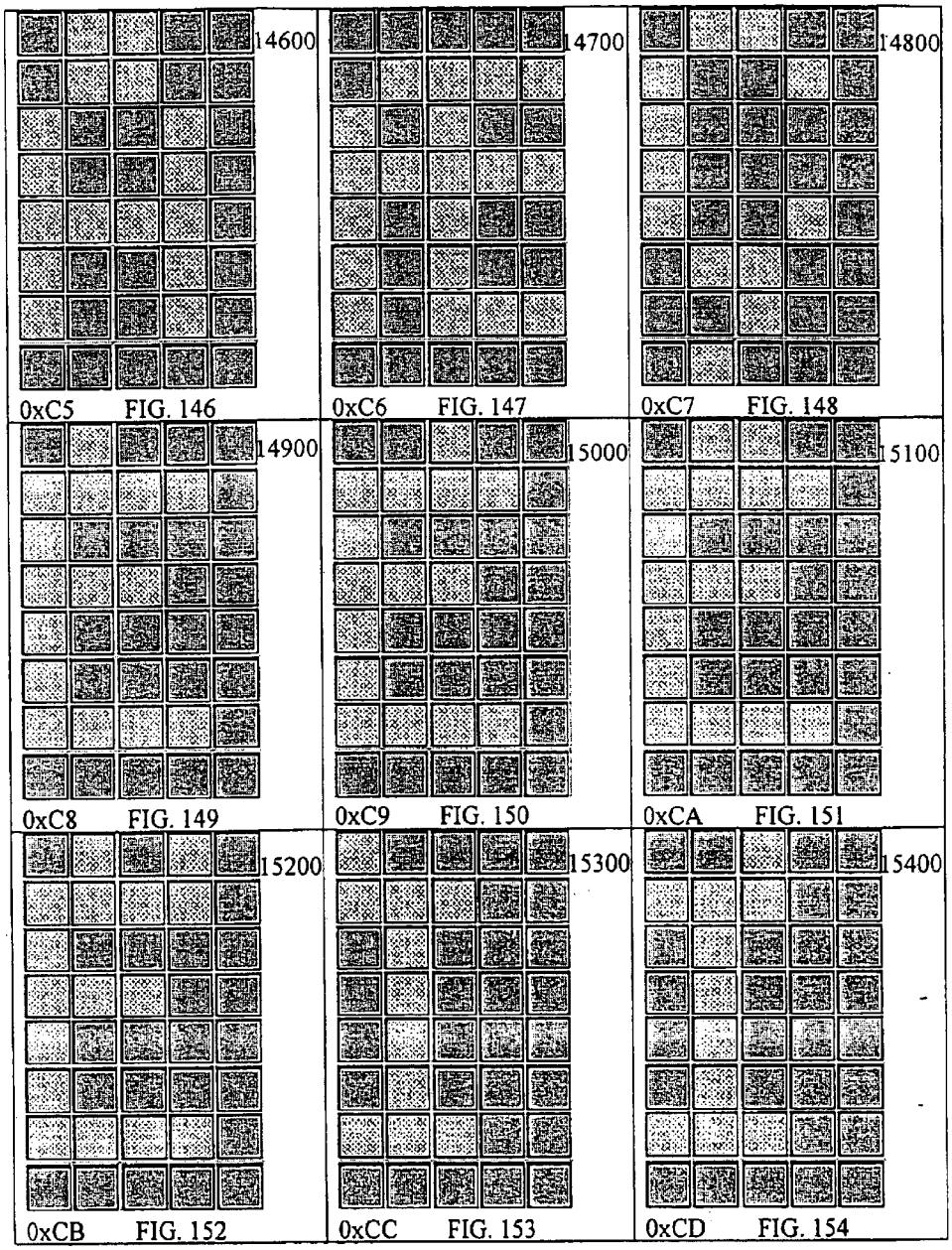
14600
14700
14800
0xC5 FIG. 146
0xC6 FIG. 147
0xC7 FIG. 148
14900
15000
15100
0xC8 FIG. 149
0xC9 FIG. 150
0xCA FIG. 151
15200
15300
15400
0xCB FIG. 152
0xCC FIG. 153
0xCD FIG. 154

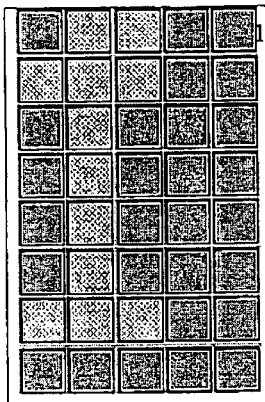
0xCE FIG. 155
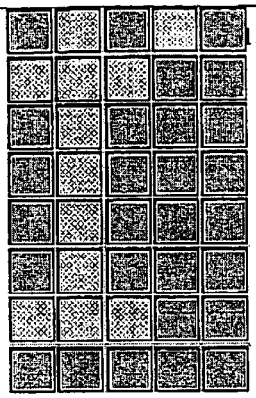
0xCF FIG. 156
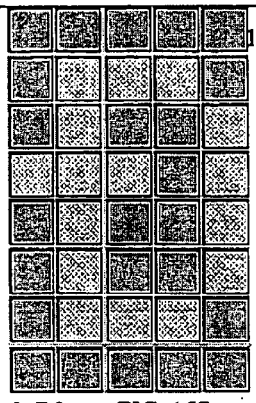
0xD0 FIG. 157
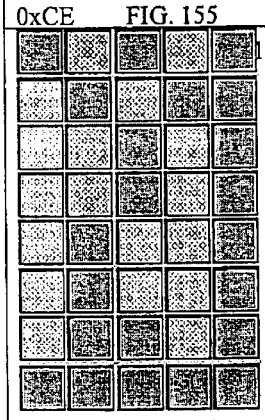
0xD1 FIG. 158
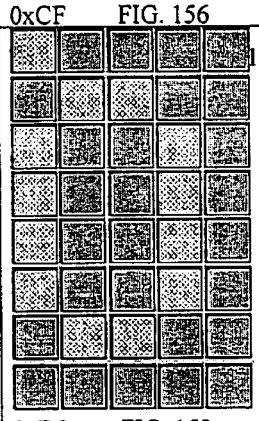
0xD2 FIG. 159
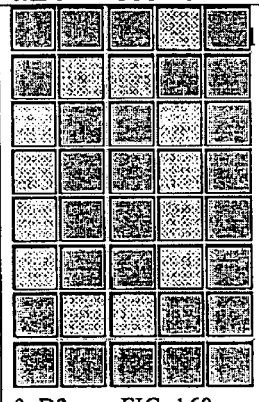
0xD3 FIG. 160
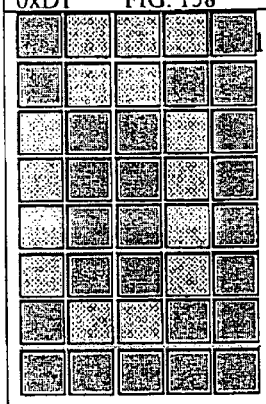
0xD4 FIG. 161
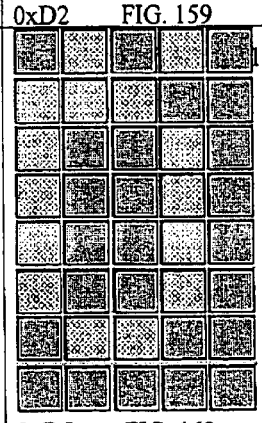
0xD5 FIG. 162
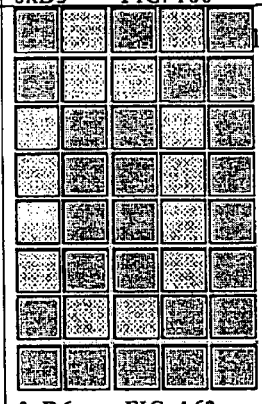
0xD6 FIG. 163

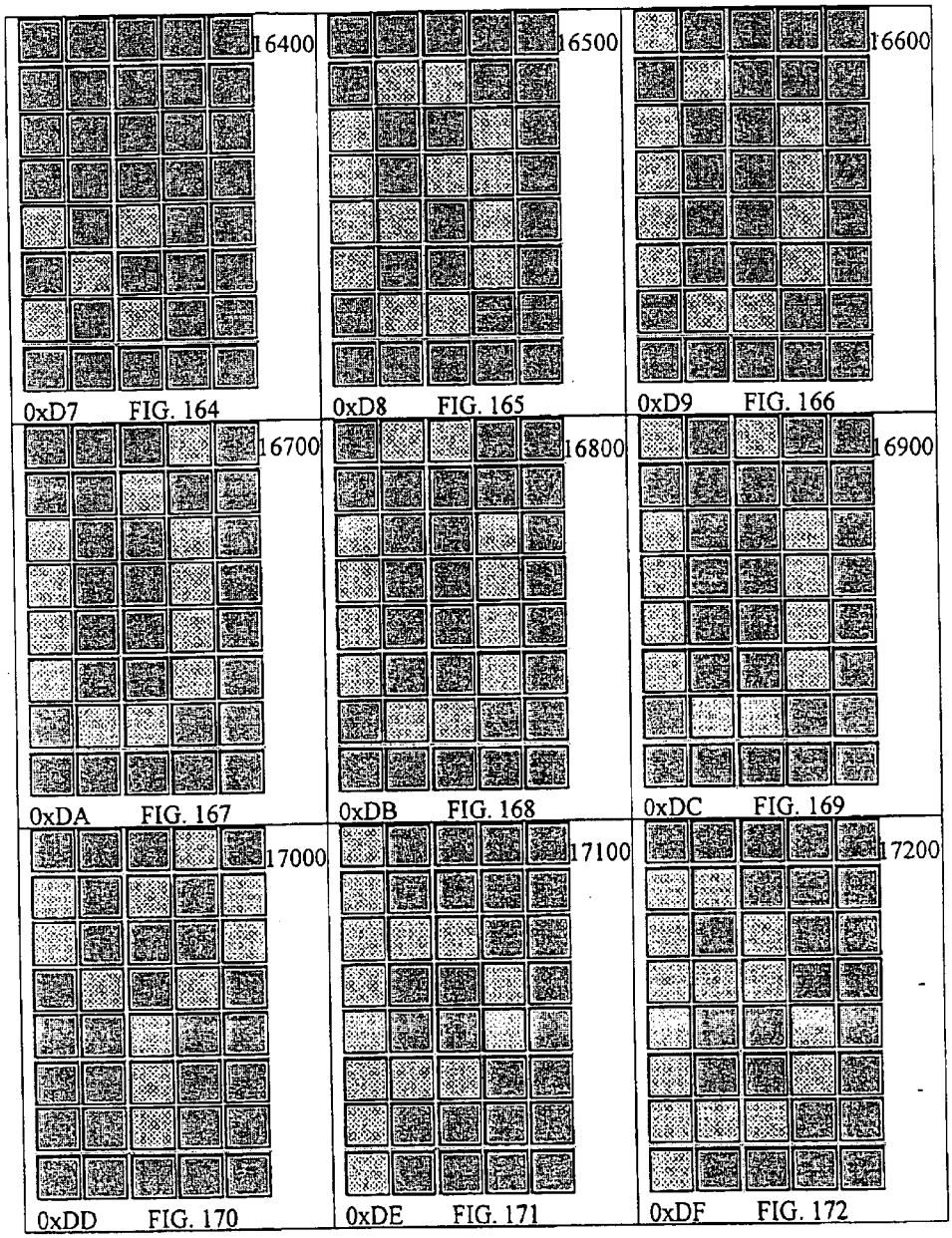
16400
0xD7 FIG. 164
16500
0xD8 FIG. 165
16600
0xD9 FIG. 166
16700
0xDA FIG. 167
16800
0xDB FIG. 168
16900
0xDC FIG. 169
17000
0xDD FIG. 170
17100
0xDE FIG. 171
17200
0xDF FIG. 172

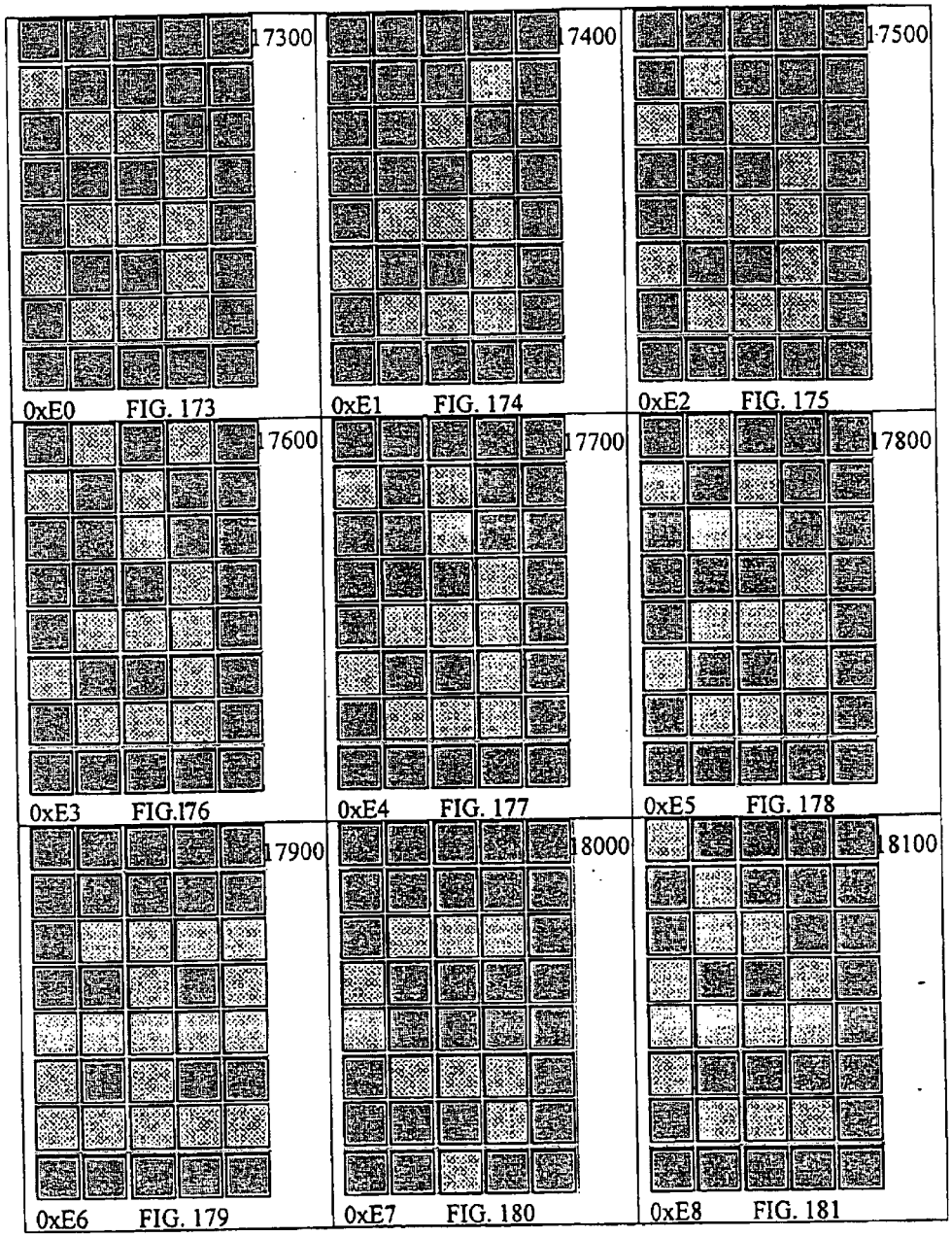
17300
0xE0 FIG. 173
17400
0xE1 FIG. 174
17500
0xE2 FIG. 175
17600
0xE3 FIG.176
17700
0xE4 FIG. 177
17800
0xE5 FIG. 178
17900
0xE6 FIG. 179
18000
0xE7 FIG. 180
18100
0xE8 FIG. 181

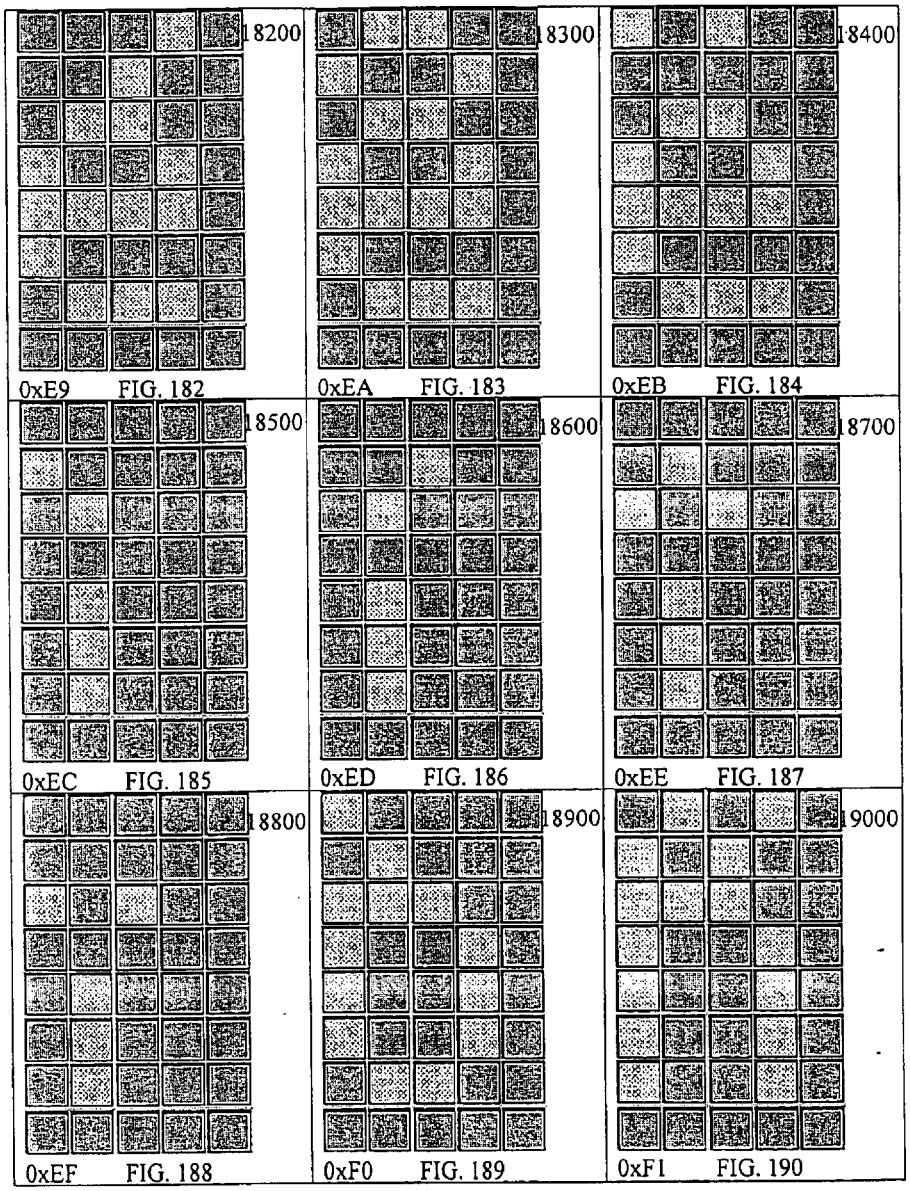
18200
0xE9 FIG. 182
18300
0xEA FIG. 183
18400
0xEB FIG. 184
18500
0xEC FIG. 185
18600
0xED FIG. 186
18700
0xEE FIG. 187
18800
0xEF FIG. 188
18900
0xF0 FIG. 189
19000
0xF1 FIG. 190

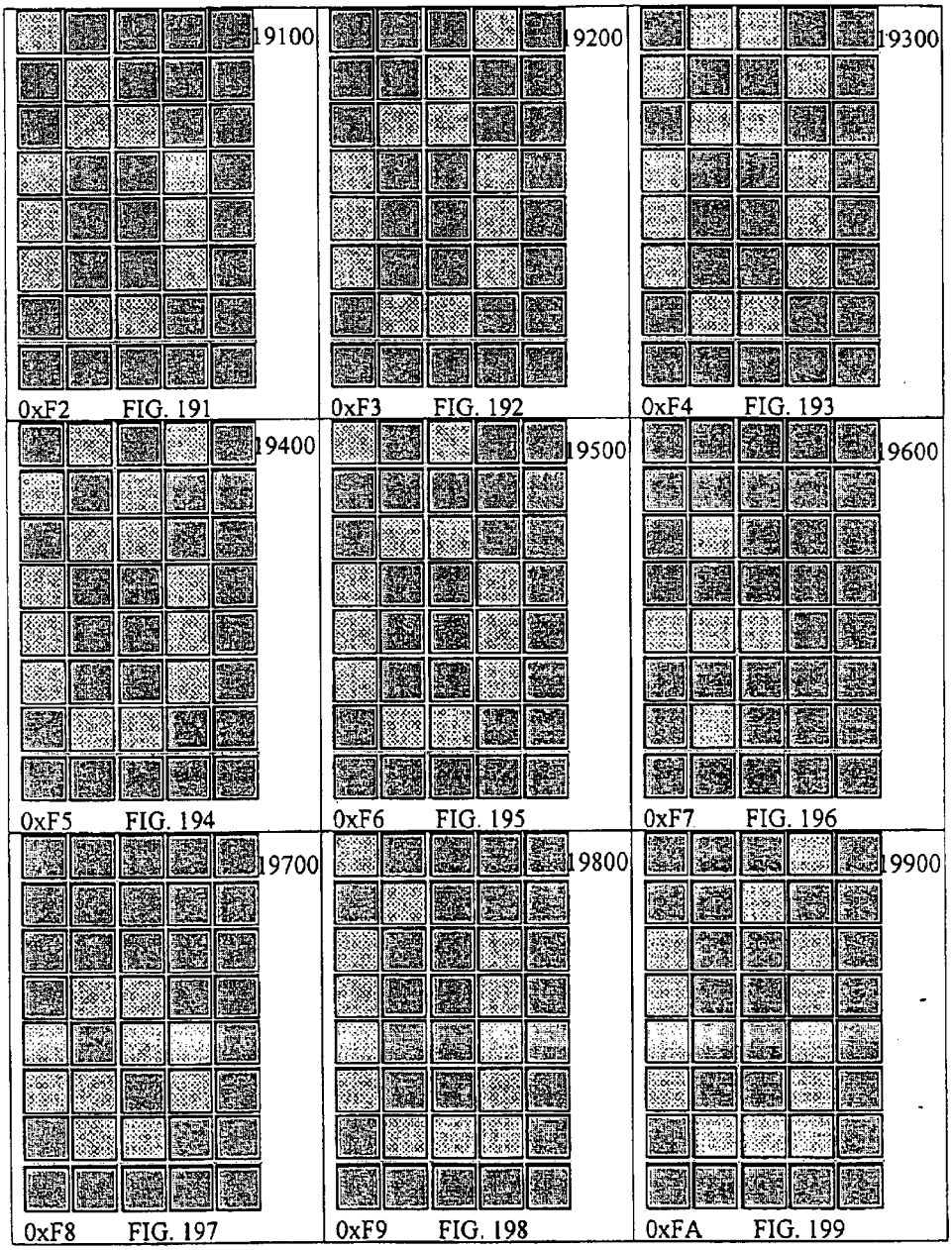
19100
0xF2 FIG. 191
19200
0xF3 FIG. 192
19300
0xF4 FIG. 193
19400
0xF5 FIG. 194
19500
0xF6 FIG. 195
19600
0xF7 FIG. 196
19700
0xF8 FIG. 197
19800
0xF9 FIG. 198
19900
0xFA FIG. 199

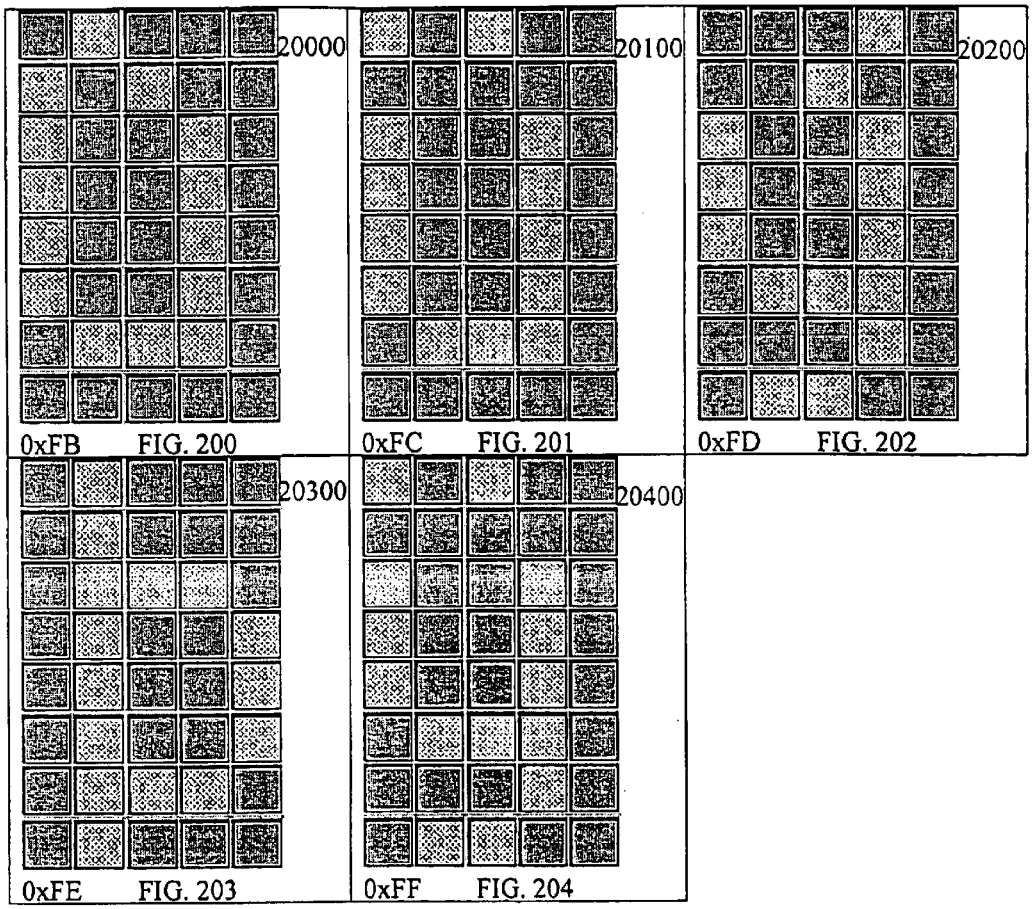
20000
0xFB FIG. 200
20100
0xFC FIG. 201
20200
0xFD FIG. 202
20300
0xFE FIG. 203
20400
0xFF FIG. 204

DISPLAYING CHARACTERS ON A DOT-MATRIX DISPLAY

BACKGROUND

This invention relates to displaying characters on a dot-matrix display.

Devices such as computers, telephones, watches, pagers, and personal digital assistants can display data to a user on a dot-matrix display screen. Characters can be formed on the display by turning certain pixels "on" and other pixels "off." The alignment of "on" and "off" pixels creates the appearance of characters on the display screen.

DESCRIPTION OF DRAWINGS

FIGS. 2–204 illustrate characters in a font in accordance with an embodiment of the invention.

DESCRIPTION

Figure 1:
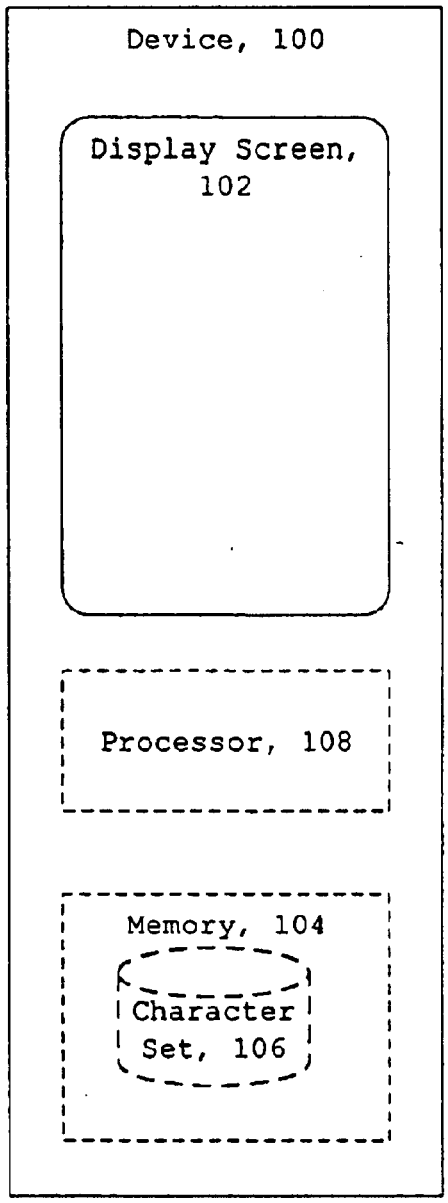
FIG. 1 is a block diagram of a device in accordance with an embodiment of the invention.

Referring to FIG. 1, a device 100 includes a display screen 102 with a fixed, finite area and a capability to display readable characters to a user. The device 100 can be any device capable of processing glyphs for display on the display screen 102 with a processing mechanism 108, e.g., computers, telephones, watches, pagers, and personal digital assistants. Glyphs, or characters, are visual representations of letters, numbers, mathematical symbols, punctuation marks, and other symbols used to convey information in a nonverbal manner. The display screen 102 can be any dot-matrix display configured to display glyphs as collections of "on" and "off" pixels such as a liquid crystal display. In one example, the display screen 102 is 120×32 pixels and has a viewable area of 44.8 millimeters (mm) by 12.12 mm. Each pixel is a 0.3 mm square and is separated from other pixels by 0.04 mm.

The display screen 102 includes a liquid crystal display (LCD). On a dot-matrix liquid crystal display (LCD) screen, pixels are turned "on" and "off" by running a current through a liquid crystal solution located between two polarizing sheets of material. Each crystal in the solution moves according to the current, with some crystals aligning with one sheet of material and other crystals aligning with the other sheet of material. The crystals represent pixels; the crystals aligned with one sheet of material are "on" and the crystals aligned with the other sheet of material are "off."

In one example, each glyph on the display screen 102 is restricted to a box five pixels wide by eight pixels tall. Characters are displayed on the display screen 102 as an array of boxes, arranged horizontally and vertically. In this way, the device 100 can display readable and aesthetically pleasing glyphs on a display screen 102 having limited display space.

The device 100 includes a memory 104 that stores a character set 106 including a number of glyphs that can be displayed on the display screen 102. The processing mechanism 108 retrieves characters as necessary for display on the display screen 102 from the character set 106 stored in the memory 104. The processing mechanism 108 is also responsible for configuring the layout and order of the characters on the display screen 102. The processing mechanism 108 can include software, hardware, or a combination of software and hardware.

The character set 106 includes characters recognized by the device's hardware and/or software, such as uppercase letters, lowercase letters, numbers, punctuation marks, and extended characters. The character set 106 should include enough characters to support localization to English text (American and European). The characters in the character set 106 map into a subset of the International Standards Organization (ISO) Latin-1 character code set. The ISO Latin-1 character code set is a superset of an American Standard Code for Information Interchange (ASCII) character code set, a code for representing 128 English characters ranging from zero to 127. The memory 104 stores each character in the character set 106 as an eight-bit number corresponding to its numerical value. The character set values are typically referred to in hexadecimal format. The character set 106 may also include additional characters, such as characters included in an extended ASCII character code set, an American National Standards Institute (ANSI) character set, other character sets, and other individual characters.

Referring to FIGS. 2–204, in one example, the character set 106 includes 203 different characters 200–20400. Each character 200–20400 is shown in a five-by-eight pixel window with its associated hexadecimal (hex) value at the lower left of its pixel window. Characters 200–1200 include navigational characters used in navigating various elements on the display screen 102. The characters 200–20400 include:

1) a cross bar symbol 200, hex value eleven,
2) an up-back symbol 300, hex value twelve,
3) an up-forward symbol 400, hex value thirteen,
4) a down-back symbol 500, hex value fourteen,
5) a down-forward symbol 600, hex value fifteen,
6) an up short-arrow symbol 700, hex value sixteen,
7) a down short-arrow symbol 800, hex value seventeen,
8) an up scroll-arrow or long-arrow symbol 900, hex value eighteen,
9) a down scroll-arrow or long-arrow symbol 1000, hex value nineteen,
10) a right scroll-arrow symbol 1100, hex value 1A,
11) an left scroll-arrow symbol 1200, hex value 1B,
12) an exclamation mark 1300, hex value twenty-one,
13) a double quotation mark 1400, hex value twenty-two,
14) a number sign 1500, hex value twenty-three,
15) a dollar sign 1600, hex value twenty-four,
16) a percent sign 1700, hex value twenty-five,
17) an ampersand 1800, hex value twenty-six,
18) an apostrophe or single quotation mark 1900, hex value twenty-seven,
19) a left parenthesis 2000, hex value twenty-eight,
20) a right parenthesis 2100, hex value twenty-nine,
21) an asterisk 2200, hex value 2A,
22) a plus sign 2300, hex value 2B,
23) a comma 2400, hex value 2C,
24) a minus sign or hyphen 2500, hex value 2D,
25) a period, decimal point, or full stop 2600, hex value 2E,
26) a slash, virgule, or solidus 2700, hex value 2F, 27) a digit zero 2800, hex value thirty,
28) a digit one 2900, hex value thirty-one,
29) a digit two 3000, hex value thirty-two,
30) a digit three 3100, hex value thirty-three,
31) a digit four 3200, hex value thirty-four,
32) a digit five 3300, hex value thirty-five,
33) a digit six 3400, hex value thirty-six,
34) a digit seven 3500, hex value thirty-seven,
35) a digit eight 3600, hex value thirty-eight,
36) a digit nine 3700, hex value thirty-nine,
37) a colon 3800, hex value 3A,
38) a semicolon 3900, hex value 3B,
39) a less-than sign 4000, hex value 3C,
40) an equal sign 4100, hex value 3D,
41) a greater-than sign 4200, hex value 3E,
42) a question mark 4300, hex value 3F,
43) an at sign 4400, hex value forty,
44) a capital letter A 4500, hex value forty-one,
45) a capital letter B 4600, hex value forty-two,
46) a capital letter C 4700, hex value forty-three,
47) a capital letter D 4800, hex value forty-four,
48) a capital letter E 4900, hex value forty-five,
49) a capital letter F 5000, hex value forty-six,
50) a capital letter G 5100, hex value forty-seven,
51) a capital letter H 5200, hex value forty-eight,
52) a capital letter I 5300, hex value forty-nine,
53) a capital letter J 5400, hex value 4A,
54) a capital letter K 5500, hex value 4B,
55) a capital letter L 5600, hex value 4C,
56) a capital letter M 5700, hex value 4D,
57) a capital letter N 5800, hex value 4E,
58) a capital letter O 5900, hex value 4F,
59) a capital letter P 6000, hex value fifty,
60) a capital letter Q 6100, hex value fifty-one,
61) a capital letter R 6200, hex value fifty-two,
62) a capital letter S 6300, hex value fifty-three,
63) a capital letter T 6400, hex value fifty-four,
64) a capital letter U 6500, hex value fifty-five,
65) a capital letter V 6600, hex value fifty-six,
66) a capital letter W 6700, hex value fifty-seven,
67) a capital letter X 6800, hex value fifty-eight,
68) a capital letter Y 6900, hex value fifty-nine,
69) a capital letter Z 7000, hex value 5A,
70) a left square bracket 7100, hex value 5B,
71) a backslash or reverse solidus 7200, hex value 5C,
72) a right square bracket 7300, hex value 5D,
73) a spacing circumflex accent 7400, hex value 5E,
74) a spacing underscore, low line, or horizontal bar 7500, hex value 5F,
75) a spacing accent or back apostrophe 7600, hex value sixty,
76) a lowercase letter a 7700, hex value sixty-one,
77) a lowercase letter b 7800, hex value sixty-two,
78) a lowercase letter c 7900, hex value sixty-three,
79) a lowercase letter d 8000, hex value sixty-four,
80) a lowercase letter e 8100, hex value sixty-five,
81) a lowercase letter f 8200, hex value sixty-six,
82) a lowercase letter g 8300, hex value sixty-seven,
83) a lowercase letter h 8400, hex value sixty-eight,
84) a lowercase letter i 8500, hex value sixty-nine,
85) a lowercase letter j 8600, hex value 6A,
86) a lowercase letter k 8700, hex value 6B,
87) a lowercase letter l 8800, hex value 6C,
88) a lowercase letter m 8900, hex value 6D,
89) a lowercase letter n 9000, hex value 6E,
90) a lowercase letter o 9100, hex value 6F,
91) a lowercase letter p 9200, hex value seventy,
92) a lowercase letter q 9300, hex value seventy-one,
93) a lowercase letter r 9400, hex value seventy-two,
94) a lowercase letter s 9500, hex value seventy-three,
95) a lowercase letter t 9600, hex value seventy-four,
96) a lowercase letter u 9700, hex value seventy-five,
97) a lowercase letter v 9800, hex value seventy-six,
98) a lowercase letter w 9900, hex value seventy-seven,
99) a lowercase letter x 10000, hex value seventy-eight,
100) a lowercase letter y 10100, hex value seventy-nine,
101) a lowercase letter z 10200, hex value 7A,
102) a left brace or curly bracket 10300, hex value 7B,
103) a vertical bar 10400, hex value 7C,
104) a right brace or curly bracket 10500, hex value 7D,
105) a tilde 10600, hex value 7E,
106) a Euro symbol 10700, hex value eighty,
107) a left single quotation mark or a high right rising single quotation mark 10800, hex value ninety-one,
108) a right single quotation mark 10900, hex value ninety-two,
109) an inverted exclamation mark 11000, hex value A1,
110) a cent sign 11100, hex value A2,
111) a pound sterling sign 11200, hex value A3,
112) a general currency sign 11300, hex value A4,
113) a yen sign 11400, hex value A5,
114) a broken vertical bar 11500, hex value A6,
115) a section sign 11600, hex value A7,
116) a spacing dieresis or umlaut 11700, hex value A8,
117) a copyright sign 11800, hex value A9,
118) a feminine ordinal indicator 11900, hex value AA,
119) a left (double) angle quote or guillemet 12000, hex value AB,
120) a logical not sign 12100, hex value AC,
121) a soft hyphen 12200, hex value AD,
122) a registered trademark sign 12300, hex value AE,
123) a spacing macron (long) accent 12400, hex value AF,
124) a degree sign 12500, hex value B0,
125) a plus-or-minus sign 12600, hex value B1,
126) a superscript number two 12700, hex value B2,
127) a superscript number three 12800, hex value B3,
128) a spacing acute accent 12900, hex value B4,
129) a micro sign 13000, hex value B5,
130) a paragraph sign or pilcrow sign 13100, hex value B6,
131) a middle dot or centered dot 13200, hex value B7,
132) a spacing cedilla 13300, hex value B8,
133) a superscript number one 13400, hex value B9,
134) a masculine ordinal indicator 13500, hex value BA, 135) a right (double) angle quote or guillemet 13600, hex value BB, 136) a one-quarter fraction 13700, hex value BC, 137) a one-half fraction 13800, hex value BD, 138) a three-quarter fraction 13900, hex value BE, 139) an inverted question mark 14000, hex value BF, 140) a capital letter A grave 14100, hex value C0, 141) a capital letter A acute 14200, hex value C1, 142) a capital letter A circumflex 14300, hex value C2, 143) a capital letter A tilde 14400, hex value C3, 144) a capital letter A dieresis or umlaut 14500, hex value C4, 145) a capital letter A ring 14600, hex value C5, 146) an uppercase AE ligature 14700, hex value C6, 147) a capital letter C cedilla 14800, hex value C7, 148) a capital letter E grave 14900, hex value C8, 149) a capital letter E acute 15000, hex value C9, 150) a capital letter E circumflex 15100, hex value CA, 151) a capital letter E dieresis or umlaut 15200, hex value CB, 152) a capital letter I grave 15300, hex value CC, 153) a capital letter I acute 15400, hex value CD, 154) a capital letter I circumflex 15500, hex value CE, 155) a capital letter I dieresis or umlaut 15600, hex value CF, 156) an uppercase ETH 15700, hex value D0, 157) a capital letter N tilde 15800, hex value D1, 158) a capital letter O grave 15900, hex value D2, 159) a capital letter O acute 16000, hex value D3, 160) a capital letter O circumflex 16100, hex value D4, 161) a capital letter O tilde 16200, hex value D5, 162) a capital letter O dieresis or umlaut 16300, hex value D6, 163) a multiplication sign 16400, hex value D7, 164) a capital letter O slash 16500, hex value D8, 165) a capital letter U grave 16600, hex value D9, 166) a capital letter U acute 16700, hex value DA, 167) a capital letter U circumflex 16800, hex value DB, 168) a capital letter U dieresis or umlaut 16900, hex value DC, 169) a capital letter Y acute 17000, hex value DD, 170) an uppercase THORN 17100, hex value DE, 171) a small sharp s, sz ligature 17200, hex value 172) a lowercase letter a grave 17300, hex value E0, 173) a lowercase letter a acute 17400, hex value E1, 174) a lowercase letter a circumflex 17500, hex value E2, 175) a lowercase letter a tilde 17600, hex value E3, 176) a lowercase letter a dieresis or umlaut 17700, hex value E4, 177) a lowercase letter a ring 17800, hex value E5, 178) a lowercase ae ligature 17900, hex value E6, 179) a lowercase letter c cedilla 18000, hex value E7, 180) a lowercase letter e grave 18100, hex value E8, 181) a lowercase letter e acute 18200, hex value E9, 182) a lowercase letter e circumflex 18300, hex value EA, 183) a lowercase letter e dieresis or umlaut 18400, hex value EB, 184) a lowercase letter i grave 18500, hex value EC, 185) a lowercase letter i acute 18600, hex value ED, 186) a lowercase letter i circumflex 18700, hex value EE, 187) a lowercase letter i dieresis or umlaut 18800, hex value EF, 188) a lowercase eth 18900, hex value F0, 189) a lowercase letter n tilde 19000, hex value F1, 190) a lowercase letter o grave 19100, hex value F2, 191) a lowercase letter o acute 19200, hex value F3, 192) a lowercase letter o circumflex 19300, hex value F4, 193) a lowercase letter o tilde 19400, hex value F5, 194) a lowercase letter o dieresis or umlaut 19500, hex value F6, 195) a division sign 19600, hex value F7, 196) a lowercase letter o slash 19700, hex value F8, 197) a lowercase letter u grave 19800, hex value F9, 198) a lowercase letter u acute 19900, hex value FA, 199) a lowercase letter u circumflex 20000, hex value FB, 200) a lowercase letter u dieresis or umlaut 20100, hex value FC, 201) a lowercase letter y acute 20200, hex value FD, 202) a lowercase thorn 20300, hex value FE, 203) a lowercase letter y dieresis or umlaut 20400, hex value FF.

Figure 205:
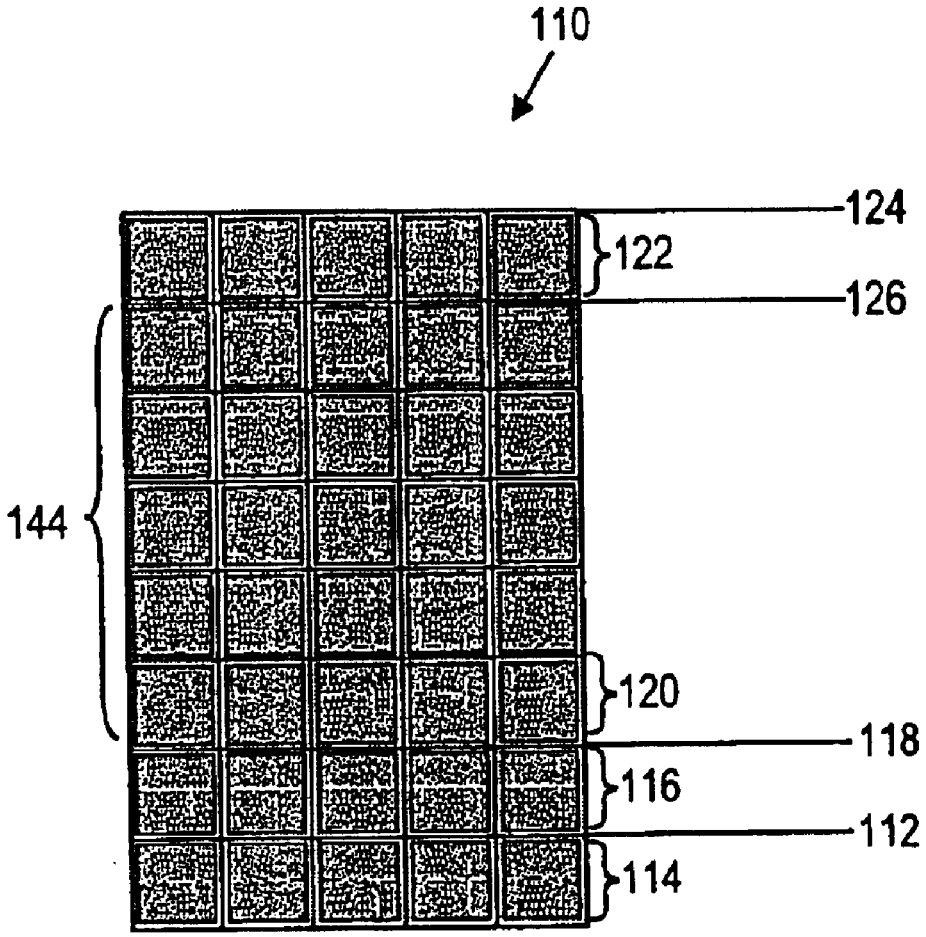
FIG. 205 illustrates a five-by-eight pixel display in accordance with an embodiment of the invention.
Figure 206:
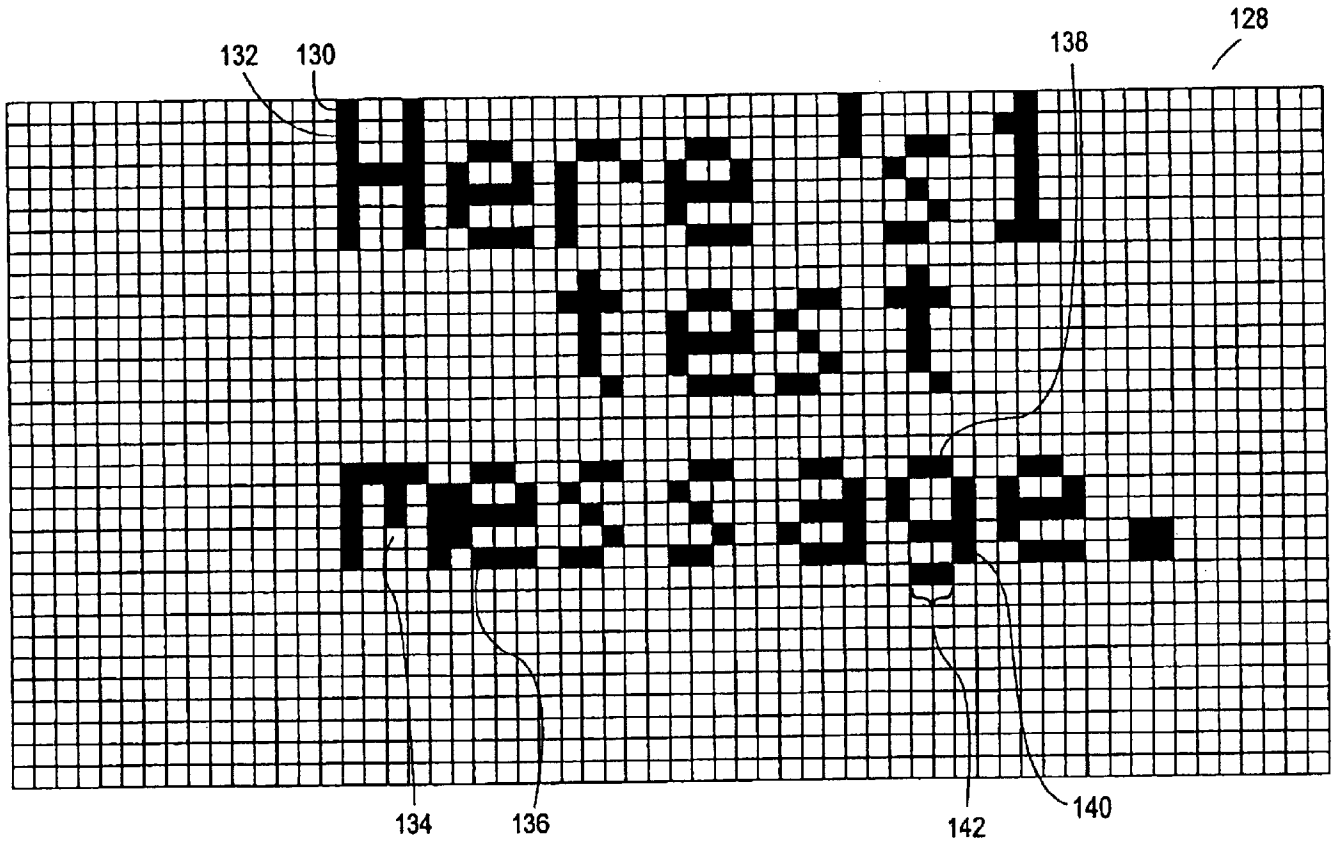
FIG. 206 illustrates characters on a display screen in accordance with an embodiment of the invention.

Referring to FIG. 205, a character in the character set 106 fits into a character space 110. On a display screen, each character space is adjacent on all four sides to another character space (except for character spaces along an edge of the display screen). FIG. 206 shows sample characters on a sixty pixel by thirty-two pixel display screen 128 having room for forty-eight characters. The pixels in FIG. 206 are shown flush against one another (e.g., pixels 130 and 132), but there is a small space in-between each pixel on an actual display screen to prevent character contact, such as that in FIG. 206 with the "m" 134 and the second to last "e" 136 in the sample message.

The character space 110 is defined by lines and spaces indicating where characters lie within the character space 110. A character baseline indicates a horizontal line upon which characters in the character set 106 rest when displayed. The character set 106 includes two character baselines. A common baseline 112 for characters that do not have a descender exists between a bottom row 114 and a second-to-last row 116 of the character space 110. A descender is a portion of a character that falls below the character's character baseline. Characters that have a descender include the lowercase letter p 9200, the capital letter Q 6100, and the cent sign 11100.

An extended baseline 118 exists between the second-to-last row 116 and a third-to-last row 120 of the character space 110 for characters that have a descender. Space exists in the character space 110 below the extended baseline 118 to allow space for a two-pixel-high descender with one pixel for an opening and one pixel for a tail. For example, the "g" 138 in the test message includes a one-pixel opening 140 and a two-pixel tail 142.

Additionally, sufficient room exists above the extended baseline 118 for capline characters while preventing bleeding between rows. Capline characters are those characters that include pixels in a top row 122 of the character space, the row directly below a capline 124. The capline 124 indicates the height of an uppercase letter M, the height used to convey the uppermost height of a character included in a character set. Therefore, the capline 124 exists above the top row 122 of the character space 110. Numbers and capital letters included in the character set 106 generally extend from the common baseline 112 to the capline 124 and, thus, are seven pixels tall. Numbers and characters having descenders may extend below the common baseline 112.

A meanline 126 is a baseline that defines the height of the body of a lowercase letter included in the character set 106, e.g., the letters a to z 7700–10200. In other words, the meanline 126 indicates the vertical rise of an x-height 144 above the character baseline. The x-height 144 of the character space 110 is generally restricted to five pixels, so the meanline 126 is located five rows above the extended baseline 118. The x-height 144 generally refers to the height of the lowercase letter x 10000, the height used to convey the average height of all lowercase letters without ascenders or descenders. Ascenders are portions of characters that extend above the meanline 126. Characters that have an ascender include the lowercase letter d 8000, the section sign 11600, and the digit three 3100. Space exists in the character space 110 above the meanline 126 to provide room for ascenders to have sufficient height before hitting the capline 124.

Characters in the character space 110 maintain a standard width of four pixels, one pixel less than the width of the character space 110. This standard width allows for a single pixel-column break between adjacent characters. Some characters are five pixels wide, e.g., the capital letter M 5700, the capital letter W 6700, and the capital letter Y 6900.

All of the characters included in the character set 106 are left justified in the character space 110. This justification provides consistency for the location of the single pixel-column break between characters. All characters could instead be right justified.

Narrow punctuation marks, e.g., those marks limited to one column of pixels, are indented two columns from the left (three columns from the left if all characters are right justified). Narrow punctuation marks include an exclamation point 1300 and a colon 3800. This indentation prevents the narrow punctuation marks from fitting too closely to the left-hand side of adjacent characters without leaving too much space before the right-hand character.

Other embodiments are within the scope of the following claims.

What is claimed is:

1. An apparatus comprising:

characters for display on a display device; and an array of pixel boxes for displaying the characters, where each of the characters is justified against one side of a pixel box included in the array of pixel boxes and occupies a standard width of four pixels in the pixel box, each of the characters that is a lowercase character not including a descender rests upon a horizontal line above a row of pixels one row from the bottom of the pixel box, and each of the characters that is a lower case character including a descender rests upon a horizontal line above a row of pixels two rows from the bottom of the pixel box.

2. The apparatus of claim 1 in which each of the characters that does not include an ascender does not extend beyond a horizontal line above a row of pixels one row from the top of the pixel box.

3. The apparatus of claim 1 in which each of the characters is justified against the left side of the pixel box.

4. The apparatus of claim 1 in which each of the characters that is confined to a single column of pixels is located in a column located two columns from the side of the pixel box that each of the characters is justified against.

5. The apparatus of claim 1 in which the display device includes a liquid crystal dot-matrix display device.

6. The apparatus of claim 1 in which the characters include Latin International Standards Organization characters.

7. The apparatus of claim 1 in which each of the pixel boxes has a dimension of five pixels long by eight pixels tall.

8. An apparatus comprising:

a display screen;

a memory configured to store a character set including characters, each of the characters to occupy a character space on the display screen, where each of the characters is justified against one side of the character space and occupies a standard width of four pixels in the character space, where each of the characters that is a lowercase character without descender rests upon a horizontal line above a row of pixels one row from the bottom of the character space, and each of the characters that is a lowercase character with a descender rests upon a horizontal line above a row of pixels two rows from the bottom of the character space; and a mechanism configured to display characters included in the character set on the display screen.

9. The apparatus of claim 8 in which each of the characters that does not include an ascender does not extend beyond a horizontal line above a row of pixels one row from the top of the character space.

10. The apparatus of claim 8 in which each of the characters is justified against the left side of the character space.

11. The apparatus of claim 8 in which each of the characters that is confined to a single column of pixels is located in a column located two columns from the side of the character space that each of the characters is justified against.

12. The apparatus of claim 8 in which the display screen includes a liquid crystal dot-matrix screen.

13. The apparatus of claim 8 in which the characters include Latin International Standards Organization characters.

14. The apparatus of claim 8 in which the character space is five pixels wide by eight pixels tall.

15. An article comprising a machine-readable medium which stores machine-executable instructions, the instructions causing a machine to:

retrieve a character included in a character set from a memory; and display the character on a display screen, where each character on the display screen occupies a character space of five pixels wide by eight pixels tall, where the character is justified against one side of the character space, characters included in the character set that are lowercase and do not include descenders rest upon a horizontal line above a row of pixels one row from the bottom of the character space, and characters included in the character set that are lowercase and include descenders rest upon a horizontal line above a row of pixels two rows from the bottom of the character space.

16. The article of claim 15 in which characters included in the character set that do not include ascenders do not extend beyond a horizontal line above a row of pixels one row from the top of the character space.

17. The article of claim 15 in which characters included in the character set are justified against the left side of the character space.

18. The article of claim 15 in which characters included in the character set that are confined to a single column of pixels are located in a column located two columns from the side of the character space that the character is justified against.

19. The article of claim 15 in which the display screen includes a liquid crystal dot-matrix screen.

20. An apparatus comprising:

an array of pixel boxes for displaying characters on a liquid crystal dot-matrix display device, where each of the characters is justified against a left side of a pixel box included in the array of pixel boxes and each of the pixel boxes included in the array of pixel boxes is separated from adjacent pixel boxes on the display device by a space; and characters for display on the display device, including:

descender characters for display in pixel boxes included in the array of pixel boxes, each of the descender characters including a descender and resting upon a horizontal line above a row of pixels two rows from the bottom of a pixel box;

non-describer characters for display in pixel boxes included in the array of pixel boxes, each of the non-descender characters resting upon a horizontal line above a row of pixels one row from the bottom of a pixel box; and non-ascender characters for display in pixel boxes included in the array of pixels boxes, each of the non-ascender characters resting upon a horizontal line above a row of pixels one row from the bottom of a pixel box.

21. The apparatus of claim 20 in which each of the pixel boxes included in the array of pixel boxes has a dimension of five pixels long by eight pixels tall and each of the characters occupies a standard width of four pixels in a pixel box included in the array of pixel boxes.

* * * * *

UNITED STATES PATENT AND TRADEMARK OFFICE

CERTIFICATE OF CORRECTION

PATENT NO. : 6,795,074 B1
DATED : September 21, 2004
INVENTOR(S) : McBride et al.

It is certified that error appears in the above-identified patent and that said Letters Patent is hereby corrected as shown below:

Column 5,
Line 50, after "hex value" insert -- DF, --.

Signed and Sealed this

Third Day of May, 2005

JON W. DUDAS
*Director of the United States Patent and Trademark Office*